US011521526B2

(12) United States Patent
Nohtomi et al.

(10) Patent No.: US 11,521,526 B2
(45) Date of Patent: Dec. 6, 2022

(54) DEVICE AND METHOD FOR TESTING INTERCONNECTION OF DISPLAY MODULE

(71) Applicant: SYNAPTICS INCORPORATED, San Jose, CA (US)

(72) Inventors: Shinobu Nohtomi, Tokyo (JP); Sosuke Tsuji, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 664 days.

(21) Appl. No.: 16/584,301

(22) Filed: Sep. 26, 2019

(65) Prior Publication Data

US 2021/0065595 A1 Mar. 4, 2021

Related U.S. Application Data

(63) Continuation-in-part of application No. 16/559,076, filed on Sep. 3, 2019, now abandoned.

(51) Int. Cl.
*G09G 3/00* (2006.01)

(52) U.S. Cl.
CPC ..... *G09G 3/006* (2013.01); *G09G 2310/027* (2013.01); *G09G 2330/12* (2013.01)

(58) Field of Classification Search
None
See application file for complete search history.

(56) References Cited

U.S. PATENT DOCUMENTS

| | | | | |
|---|---|---|---|---|
| 10,928,944 | B1 * | 2/2021 | Nohtomi | H03K 17/955 |
| 2005/0122300 | A1 * | 6/2005 | Makuuchi | G09G 3/006 345/95 |
| 2008/0068316 | A1 * | 3/2008 | Maekawa | G09G 3/3655 345/87 |
| 2012/0068988 | A1 * | 3/2012 | Kojima | G09G 3/3233 345/211 |
| 2014/0111498 | A1 * | 4/2014 | Kim | G09G 3/3291 345/82 |
| 2016/0379548 | A1 * | 12/2016 | Shin | G09G 3/20 345/214 |
| 2017/0168624 | A1 * | 6/2017 | Lee | G06F 3/0446 |
| 2019/0340966 | A1 * | 11/2019 | Lee | G09G 3/006 |

* cited by examiner

*Primary Examiner* — Patrick N Edouard
*Assistant Examiner* — Peijie Shen
(74) *Attorney, Agent, or Firm* — Ferguson Braswell Fraser Kubasta PC

(57) ABSTRACT

A display driver comprises a decoder, a first source amplifier and a logic circuitry. The decoder is configured to output a grayscale voltage corresponding to an image data. The first source amplifier is configured to output a first source output voltage corresponding to the grayscale voltage to a first external output terminal. The logic circuitry is configured to generate fault detection data for fault detection of a test object connected to the first external output terminal. The fault detection data is based on a comparison output signal generated based on a comparison between a reference voltage and a voltage on the first external output terminal. The comparison is performed by the first source amplifier.

18 Claims, 33 Drawing Sheets

DEVICE AND METHOD FOR TESTING INTERCONNECTION OF DISPLAY MODULE

CROSS REFERENCE

This application is a continuation-in-part of U.S. patent application Ser. No. 16/559,076, filed Sep. 3, 2019, which is incorporated by reference in its entirety.

BACKGROUND

Field

The present disclosure relates to a device and method for testing an interconnection of a display module.

Description of the Related Art

Interconnections connected to external output terminals of a display driver and those integrated within a display panel may experience a fault such as a short fault and an open fault. To address this, a display module comprising a display driver and a display panel may be tested to detect a fault.

SUMMARY

In one or more embodiments, a display driver comprises a decoder, a first source amplifier and logic circuitry. The decoder is configured to output a grayscale voltage corresponding to an image data. The first source amplifier is configured to output a first source output voltage corresponding to the grayscale voltage to a first external output terminal. The logic circuitry is configured to generate fault detection data for fault detection of a test object connected to the first external output terminal based on a comparison output signal. The comparison signal is generated based on a comparison between a reference voltage and a voltage on the first external output terminal. The comparison is performed by the first source amplifier.

In one or more embodiments, a display module and a display driver. The display module comprises a display panel comprising a source line. The display driver comprises an external output terminal electrically connected to the source line. The display driver comprises a decoder, a source amplifier, and logic circuitry. The decoder is configured to output a grayscale voltage corresponding to an image data. The source amplifier is configured to output a source output voltage corresponding to the grayscale voltage to the external output terminal. The logic circuitry is configured to generate fault detection data for fault detection of the source line based on a comparison output signal. The comparison output signal is generated based on a comparison between a reference voltage and a voltage on the external output terminal. The comparison is performed by the source amplifier.

In one or more embodiments, a testing method comprises supplying a reference voltage to a source amplifier configured to receive a grayscale voltage corresponding to an image data and output a first source output voltage corresponding to the grayscale voltage to a first external output terminal. The method further comprises outputting a comparison output signal based on comparison between the reference voltage and a voltage on the first external output terminal. Further, the method comprises detecting a fault in a test object connected to the first external output terminal based on the comparison output signal. The comparison is performed by the source amplifier.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1:
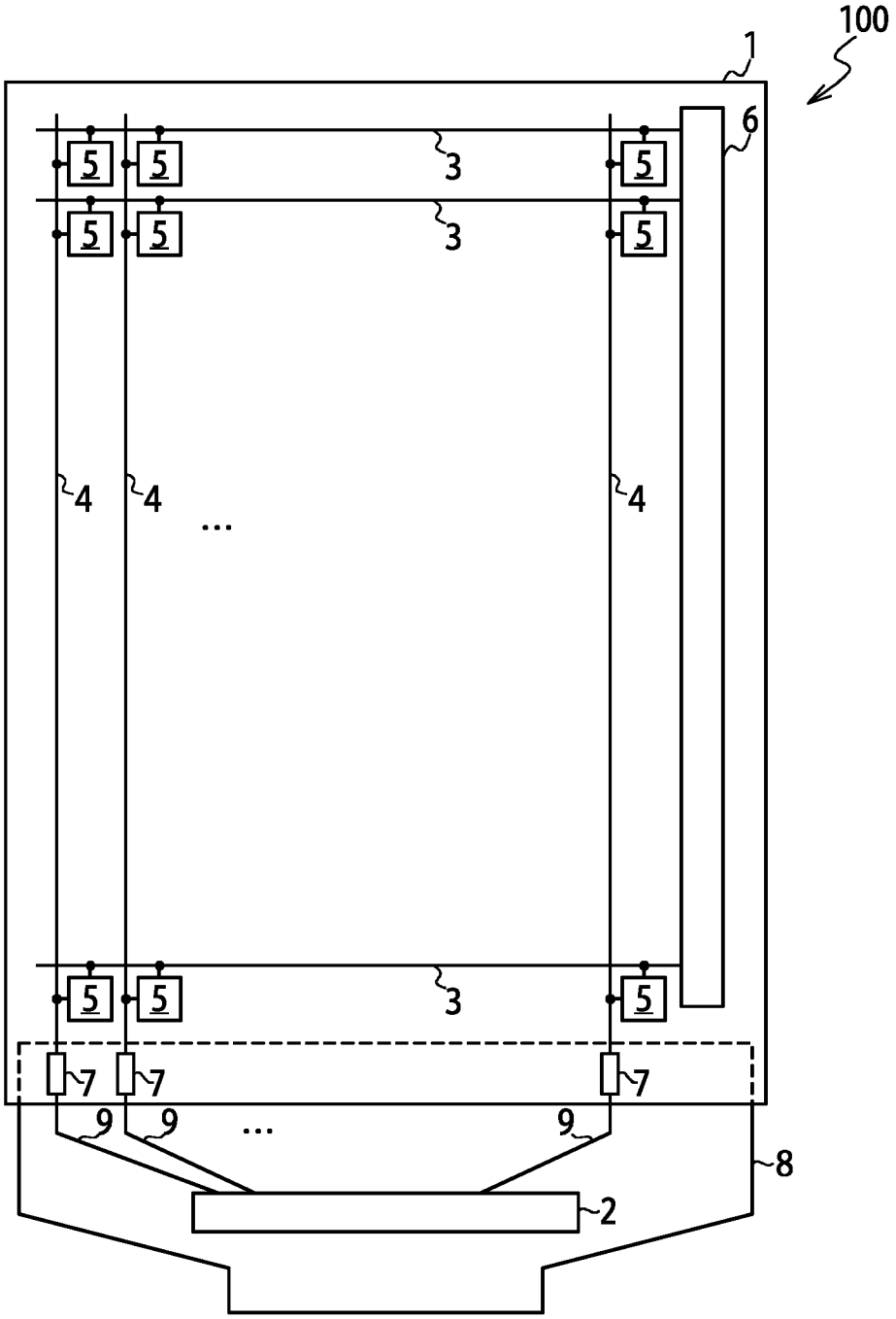
FIG. 1 illustrates one example configuration of a display module, according to one or more embodiments.

In the following, a description is given of embodiments of the present disclosure with reference to the attached drawings. In the attached drawings, same or similar components may be denoted by same or corresponding reference numerals. Suffixes may be attached to reference numerals to distinguish same components.

In one or more embodiments, as illustrated in FIG. 1, a display module 100 comprises a display panel 1 and a display driver 2 configured to drive the display panel 1. In one or more embodiments, the display panel 1 comprises gate lines 3, which may be also referred to as scan lines, source lines 4, which may be also referred to as data lines, display elements 5, gate driver circuitry 6, and external connection pads 7. In one or more embodiments, the gate lines 3 are driven by the gate driver circuitry 6. In one or more embodiments, the source lines 4 are connected to the external connection pads 7.

In one or more embodiments, each display element 5 is disposed at an intersection of the corresponding gate line 3 and source line 4. When an organic light emitting diode (OLED) display panel is used as the display panel 1, the display elements 5 may each comprise a light emitting element, a select transistor, and a hold capacitor, in one or more embodiments. When a liquid crystal display (LCD) panel is used as the display panel 1, the display elements 5 may each comprise a pixel electrode, a select transistor, and a hold capacitor, in one or more embodiments. Various lines other than the gate lines 3 and the source lines 4 may be integrated in the display panel 1 depending on the configuration of the display elements 5.

In one or more embodiments, the display driver 2 is mounted on a chip-on-flexible printed circuit (COF) 8. In one or more embodiments, the COF 8 comprises COF interconnections 9. In one or more embodiments, the COF interconnections 9 each have a first end connected to an external connection pad 7 of the display panel 1 and a second end connected to the display driver 2. This offers electrical connections to the display driver 2 for the respective source lines 4 of the display panel 1.

Figure 2:
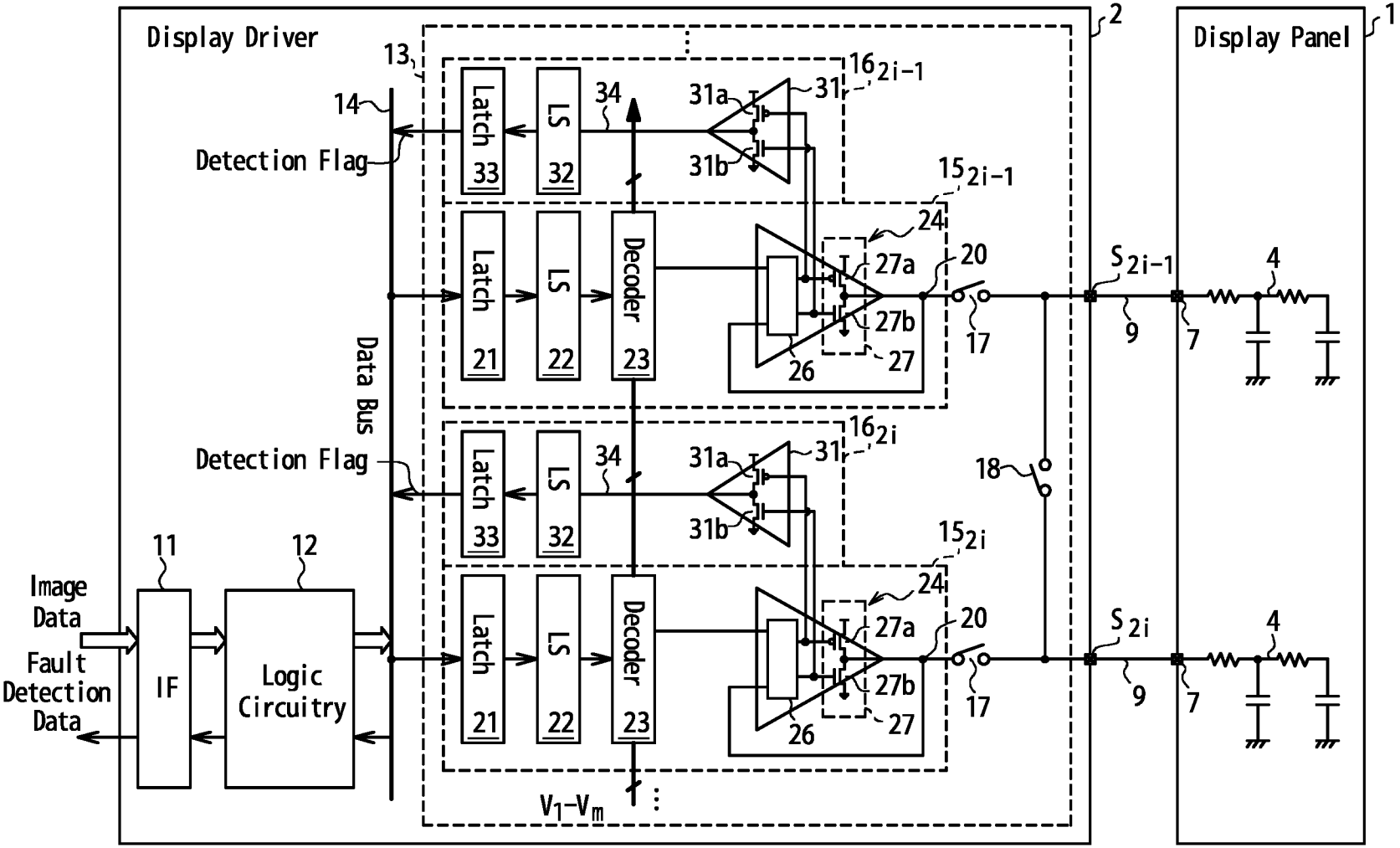
FIG. 2 illustrates one example configuration of a display driver, according to one or more embodiments.

In one or more embodiments, as illustrated in FIG. 2, the display driver 2 comprises an interface 11, logic circuitry 12, and source driver circuitry 13. In one or more embodiments, the interface 11 is configured to receive an image data from an external device (not illustrated) such as a host and forward the same to the logic circuitry 12. In one or more embodiments, the image data describes grayscale values of the respective display elements 5.

In one or more embodiments, the logic circuitry 12 is configured to supply the image data received from the interface 11 or an image data generated through desired image processing on the received image data, to the source driver circuitry 13 via a data bus 14. In one or more embodiments, the source driver circuitry 13 is configured to drive the respective source lines 4 of the display panel 1 based on the image data received from the logic circuitry 12.

In one or more embodiments, the source driver circuitry 13 comprises: output circuitries 15 configured to output source output voltages corresponding to the image data to the respective external output terminals S, test circuitries 16, output switches 17, and short-circuit switches 18 (one illustrated). In the following, the output circuitry 15 and the test circuitry 16 associated with the $j^{th}$ external output terminal $S_j$ may be referred to as output circuitry $\mathbf{15}_j$ and the test circuitry $\mathbf{16}_j$, respectively. In one or more embodiments, the output switches 17 are connected between output nodes 20 connected to the respective output circuitries 15 and the external output terminals S associated with the output circuitries 15. In one or more embodiments, a short-circuit switch 18 is connected between adjacent external outputs $S_{2i-1}$ and $S_{2i}$. In one or more embodiments, the short-circuit switches 18 are used for charge sharing between the source lines 4 connected to adjacent two of the external output terminals S, which are denoted by symbols $S_{2i-1}$ and $S_{2i}$ in FIG. 2.

In one or more embodiments, each output circuitry 15 comprises a latch 21, a level shifter 22, a decoder 23, and a source amplifier 24.

In one or more embodiments, the latch 21 is configured to receive and latch an image data from the logic circuitry 12 via the data bus 14. In one or more embodiments, the latch 21 of the output circuitry $\mathbf{15}_{2i-1}$ is configured to latch an image data corresponding to the external output terminal $S_{2i-1}$, and the latch 21 of the output circuitry $\mathbf{15}_{2i}$ is configured to latch an image data corresponding to the external output terminal $S_{2i}$.

In one or more embodiments, the level shifter 22 is configured to offer input level matching with the decoder 23 for the image data outputted from the latch 21 to supply the same to the decoder 23.

In one or more embodiments, the decoder 23 is configured to perform digital-analog conversion on the image data received from the latch 21 via the level shifter 22 to output a grayscale voltage corresponding to the image data. In one or more embodiments, grayscale voltages $V_1$ to $V_m$ corresponding to allowed grayscale values of the image data are supplied to the decoder 23. In one or more embodiments, the decoder 23 is configured to select at least one of the grayscale voltages $V_1$ to $V_m$ based on the grayscale value described in the received image data and output the selected grayscale voltage. In one or more embodiments, the grayscale voltages $V_1$ to $V_m$ have voltage levels different from one another.

In one or more embodiments, the source amplifier 24 is configured to output a source output voltage corresponding to the grayscale voltage received from the decoder 23. In one or more embodiments, the output of the source amplifier 24 is electrically connectable to a corresponding external output terminal S via the corresponding output node 20 and output switch 17. In one or more embodiments, the source amplifier 24 is configured as a voltage follower comprising a differential input stage 26 and an output stage 27. In one or more embodiments, the differential input stage 26 comprises a first input connected to the decoder 23 and a second input connected to the output node 20 and is configured to generate output signals based on comparison between voltages on the first and second inputs. In one or more embodiments, the output stage 27 is connected to the differential input stage 26 and configured to output the source output voltage based on signals received from the differential input stage 26. In one or more embodiments, the output stage 27 may comprise a PMOS transistor 27*a* configured to pull up the output of the source amplifier 24 and an NMOS transistor 27*b* configured to pull down the output of the source amplifier 24.

In one or more embodiments, each test circuitry 16 comprises comparison output circuitry 31, a level shifter 32, and a latch 33.

In one or more embodiments, the comparison output circuitry 31 is configured to output a comparison output signal 34 based on output signals received from the differential input stage 26 of the source amplifier 24. In one or more embodiments, the output signals of the differential input stage 26 are generated based on comparison between the voltages on the first and second inputs of the differential input stage 26, and therefore the comparison output signal 34 is also generated based on the comparison between the voltages on the first and second inputs of the differential input stage 26. As described later in detail, the comparison output signal 34 is generated to reflect existence of a fault in the COF interconnection 9 and the source line 4 connected to the corresponding external output terminal $S_{2i-1}$ or $S_{2i}$ in one or more embodiments. In one or more embodiments, the comparison output circuitry 31 may comprise a PMOS transistor 31*a* configured to pull up the output of the comparison output circuitry 31 and an NMOS transistor 31*b* configured to pull down the same.

In one or more embodiments, the level shifter 32 is configured to offer input level matching with the latch 33 for the comparison output signal 34 to supply the same to the latch 33.

In one or more embodiments, the latch 33 is configured to latch a value of the comparison output signal 34 received from the comparison output circuitry 31. In one or more embodiments, the value of the latch 33 is used as a detection flag. In one or more embodiments, the detection flag outputted from each latch 33 is transferred to the logic circuitry 12 via the data bus 14 and used for fault detection of the corresponding COF interconnection 9 and source line 4. In one or more embodiments, the logic circuitry 12 is configured to detect a fault in the COF interconnections 9 and source lines 4 connected to the external output terminals S based on the detection flags and generate fault detection data based on the detection result. In such embodiments, the values of the detection flags correspond to the values of the comparison output signals 34, and this allows the logic circuitry 12 to detect a fault in the COF interconnections 9 and source lines 4 based on the comparison output signals 34. In one or more embodiments, the fault detection data thus generated are outputted to an external device such as a tester via the interface 11.

In one or more embodiments, a fault in test objects connected to the external output terminals $S_{2i-1}$ and $S_{2i}$ is detected through a test by using the test circuitries $\mathbf{16}_{2i-1}$ and $\mathbf{16}_{2i}$. This test may be done in a manufacture process of the display module 100 or in a commercial distribution stage of the display module 100. In one or more embodiments, a fault in the COF interconnections 9 and source lines 4 connected to the external output terminals $S_{2i-1}$ and $S_{2i}$ is detected through a test by using the test circuitries $\mathbf{16}_{2i-1}$ and $\mathbf{16}_{2i}$. In one or more embodiments, faults to be detected may include a fault in electrical connections between the external output terminals $S_{2i-1}$, $S_{2i}$ and the COF interconnections 9 and/or a fault in electrical connections between the COF interconnections 9 and the external connection pads 7 of the display panel 1.

Figure 3:
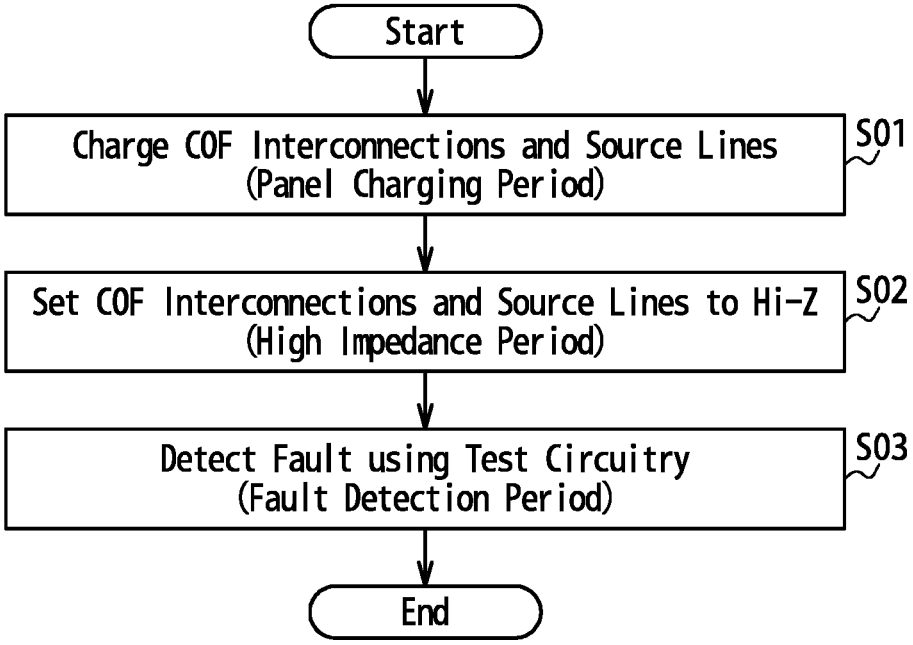
FIG. 3 illustrates one example test sequence, according to one or more embodiments.
Figure 4:
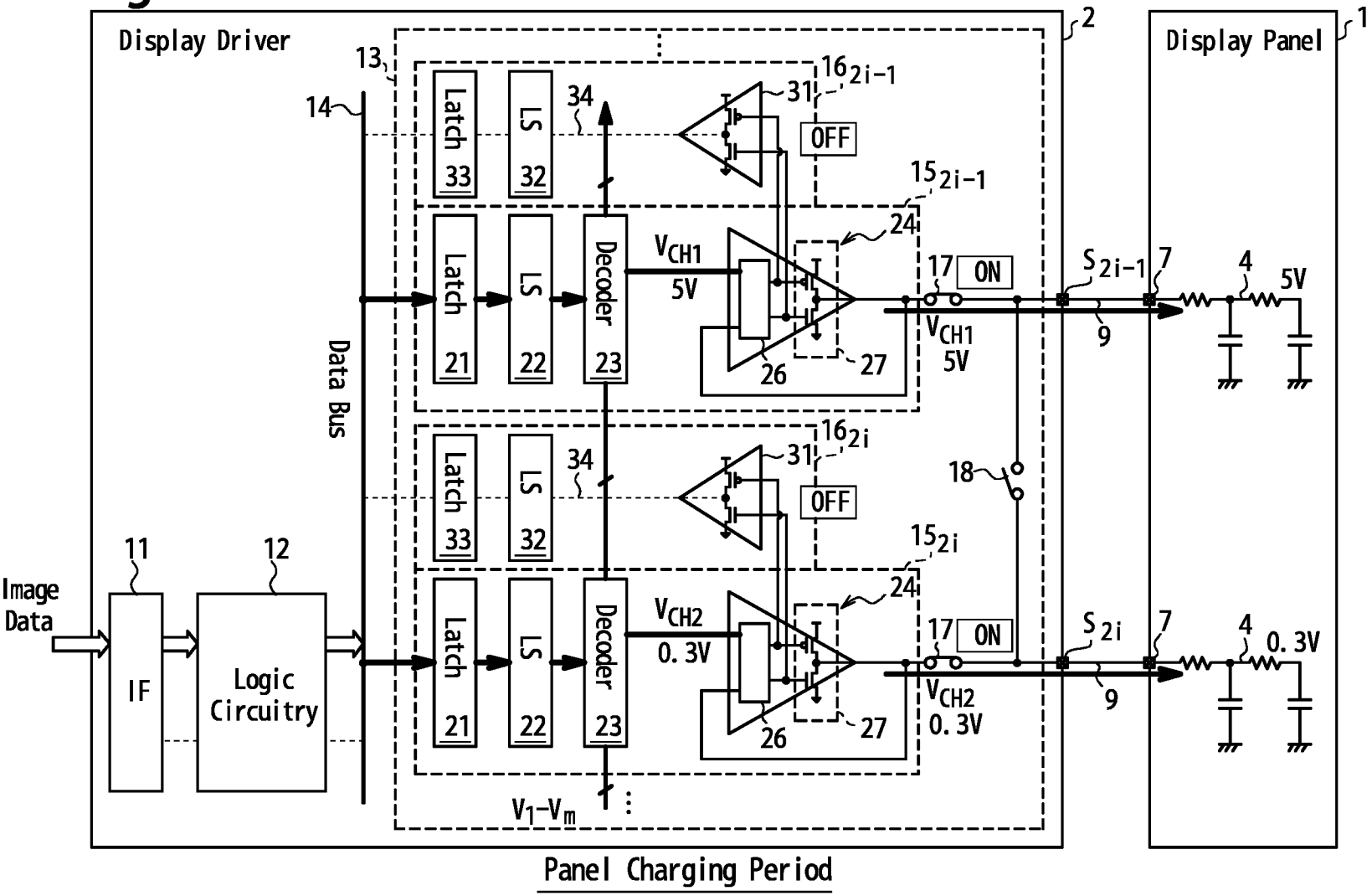
FIG. 4 illustrates one example operation of the display driver in a panel charging period, according to one or more embodiments.

In one or more embodiments, as illustrated in FIG. 3, desired source output voltages are outputted to the external output terminals $S_{2i-1}$ and $S_{2i}$ from the output circuitries $\mathbf{15}_{2i-1}$ and $\mathbf{15}_{2i}$ to charge the COF interconnections 9 and source lines 4 with the desired source output voltages in step S01. The period during which the COF interconnections 9 and source lines 4 are charged may be hereinafter referred to as "panel charging period." In one or more embodiments, as illustrated in FIG. 4, the output switches 17 are turned on with the short-circuit switches 18 turned off during the panel charging period. This allows outputting the desired source output voltages to the COF interconnections 9 and source lines 4 from the respective source amplifiers 24.

In one or more embodiments, adjacent source lines 4 are charged with different source output voltages in step S01. In one or more embodiments, one of the adjacent two source lines 4 is charged with a source output voltage $V_{CH1}$, e.g., 5V, and the other is charged with a source output voltage $V_{CH2}$, e.g., 0.3V. In other embodiments, $V_{CH1}$ may be greater than or less than 5V. Further, in various embodiments, $V_{CH2}$ may be greater than or less than 0.3V. Illustrated in FIG. 4 is one example operation in which the source output voltage $V_{CH1}$ of 5V is outputted to the odd-numbered external output terminal $S_{2i-1}$, and the source output voltage $V_{CH2}$ of 0.3V is outputted to the even-numbered external output terminal $S_{2i}$. In one or more embodiments, during the panel charging period, the COF interconnection 9 and source line 4 connected to the external output terminal $S_{2i-1}$ are charged to the source output voltage $V_{CH1}$ and the COF interconnection 9 and source line 4 connected to the external output terminal $S_{2i}$ are charged to the source output voltage $V_{CH2}$, when the COF interconnections 9 and source lines 4 are free from faults.

In one or more embodiments, grayscale voltages corresponding to the desired source output voltages $V_{CH1}$ and $V_{CH2}$ are supplied to the source amplifiers 24 from the decoders 23 in the output circuitries $\mathbf{15}_{2i-1}$ and $\mathbf{15}_{2i}$ during the panel charging period. In one or more embodiments, image data of grayscale values corresponding to the grayscale voltages corresponding to the desired source output voltages $V_{CH1}$ and $V_{CH2}$ are transferred to the latches 21 of the output circuitries $\mathbf{15}_{2i-1}$ and $\mathbf{15}_{2i}$ from the logic circuitry 12 and then supplied to the decoders 23. This operation allows outputting the desired source output voltages $V_{CH1}$ and $V_{CH2}$ from the source amplifiers 24. When the source output voltage $V_{CH1}$ of 5V is to be outputted to the odd-numbered external output terminal $S_{2i-1}$, for example, an image data of a grayscale value corresponding to a grayscale voltage of 5V is supplied to the latch 21 of the output circuitry $\mathbf{15}_{2i-1}$ and the grayscale voltage of 5V is supplied to the source amplifier 24 from the decoder 23, in one or more embodiments. Similarly, when the source output voltage $V_{CH2}$ of 0.3V is to be outputted to the even-numbered external output terminal $S_{2i}$, an image data of a grayscale value corresponding to a grayscale voltage of 0.3V is supplied to the latch 21 of the output circuitry $\mathbf{15}_{2i}$ and the grayscale voltage of 0.3V is supplied to the source amplifier 24 from the decoder 23, in one or more embodiments.

Figure 5:
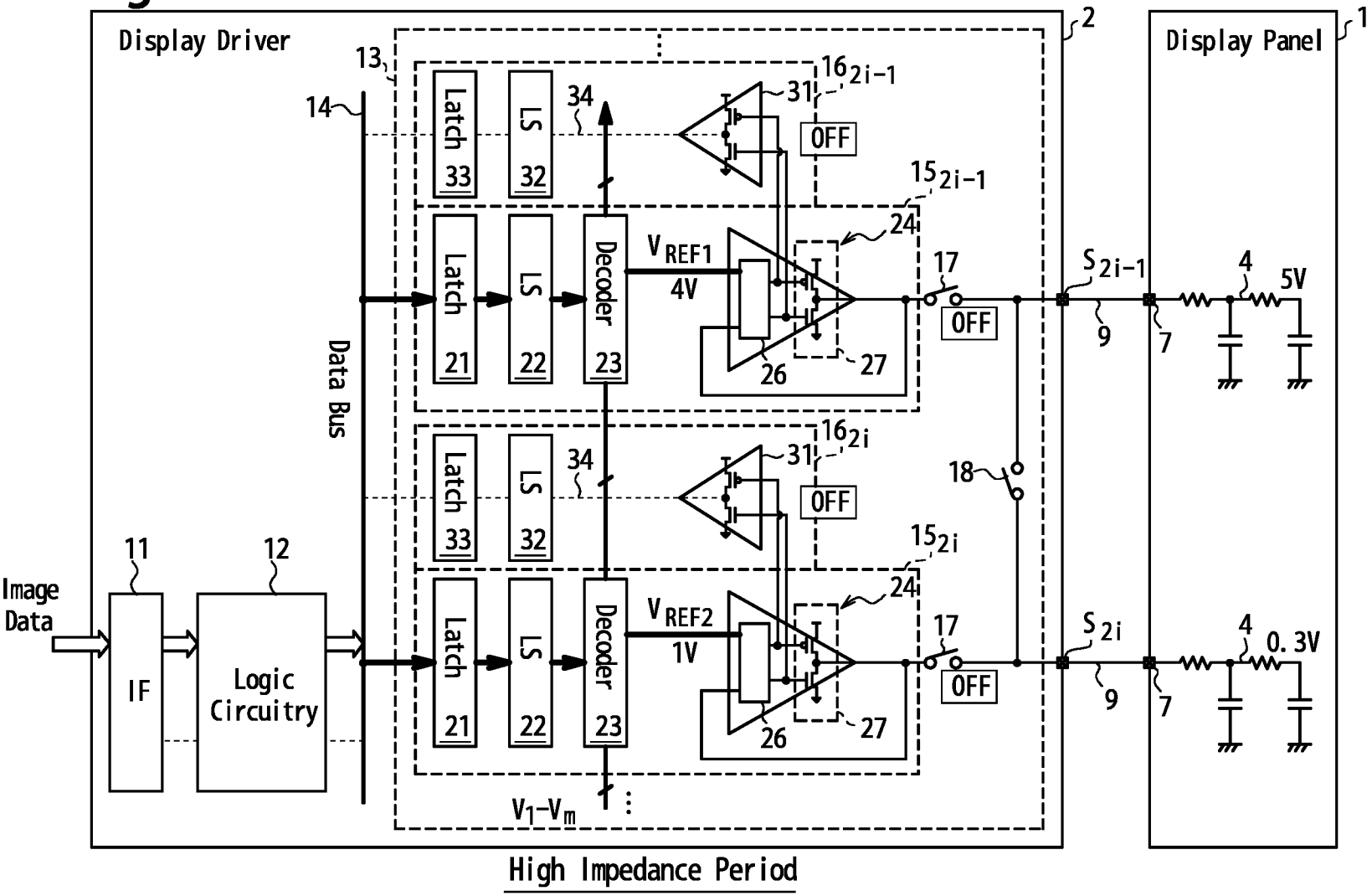
FIG. 5 illustrates one example operation of the display driver in a high impedance period, according to one or more embodiments.

Referring back to FIG. 3, in one or more embodiments, the output switches 17 are then turned off in the following step S02 to set the COF interconnections 9 and source lines 4 to high impedance (Hi-Z), as illustrated in FIG. 5. The period during which the COF interconnections 9 and source lines 4 are set to high impedance may be hereinafter referred to as high impedance period. When the COF interconnections 9 and source lines 4 are free from faults, variations in the voltage on the COF interconnections 9 and source lines 4 are small during the high impedance period. In one or more embodiments, the short-circuit switches 18 are kept turned off during the high impedance period.

In one or more embodiments, reference voltages $V_{REF1}$ and $V_{REF2}$ start to be supplied from the decoders 23 to the source amplifiers 24 in the output circuitries $\mathbf{15}_{2i-1}$ and $\mathbf{15}_{2i}$ in step S02. In one or more embodiments, the reference voltages $V_{REF1}$ and $V_{REF2}$ are referred to in fault detection in the next step S03. In one or more embodiments, the reference voltages $V_{REF1}$ and $V_{REF2}$ are determined based on expected variations in the voltages on the COF interconnections 9 and source lines 4 for the case where the COF interconnections 9 and source lines 4 are free from faults. In one or more embodiments, both the reference voltages $V_{REF1}$ and $V_{REF2}$ have voltage levels between the source output voltages $V_{CH1}$ and $V_{CH2}$. In one or more embodiments, the reference voltage $V_{REF1}$ is set to a voltage level slightly lower than that of the source output voltage $V_{CH1}$, and the reference voltage $V_{REF2}$ is set to a voltage level slightly higher than that of the source output voltage $V_{CH2}$. In one or more embodiments, the reference voltage $V_{REF1}$ has a voltage level higher than that of the reference voltage $V_{REF2}$. When the source output voltage $V_{CH1}$ of 5V is supplied to the external output terminal $S_{2i-1}$ and the source output voltage $V_{CH2}$ of 0.3V is supplied to the external output terminal $S_{2i}$, in one or more embodiments, the reference voltages $V_{REF1}$ and $V_{REF2}$ are set to 4V and 1V, respectively, for example.

In one or more embodiments, during the high impedance period, image data of grayscale values corresponding to the reference voltages $V_{REF1}$ and $V_{REF2}$ are transferred to the latches 21 of the output circuitries $\mathbf{15}_{2i-1}$ and $\mathbf{15}_{2i}$ from the logic circuitry 12 and supplied to the decoders 23. When the reference voltage $V_{REF1}$ of 4V is supplied to the source amplifier 24 of the output circuitry $\mathbf{15}_{2i-1}$, for example, an image data of a grayscale value corresponding to a grayscale voltage of 4V is supplied to the latch 21 of the output circuitry $\mathbf{15}_{2i}$, in one or more embodiments. Similarly, when the reference voltage $V_{REF2}$ of 1V is supplied to the source amplifier 24 of the output circuitry $\mathbf{15}_{2i}$, an image data of a grayscale value corresponding to a grayscale voltage of 1V is supplied to the latch 21 of the output circuitry $\mathbf{15}_{2i}$, in one or more embodiments.

Figure 6:
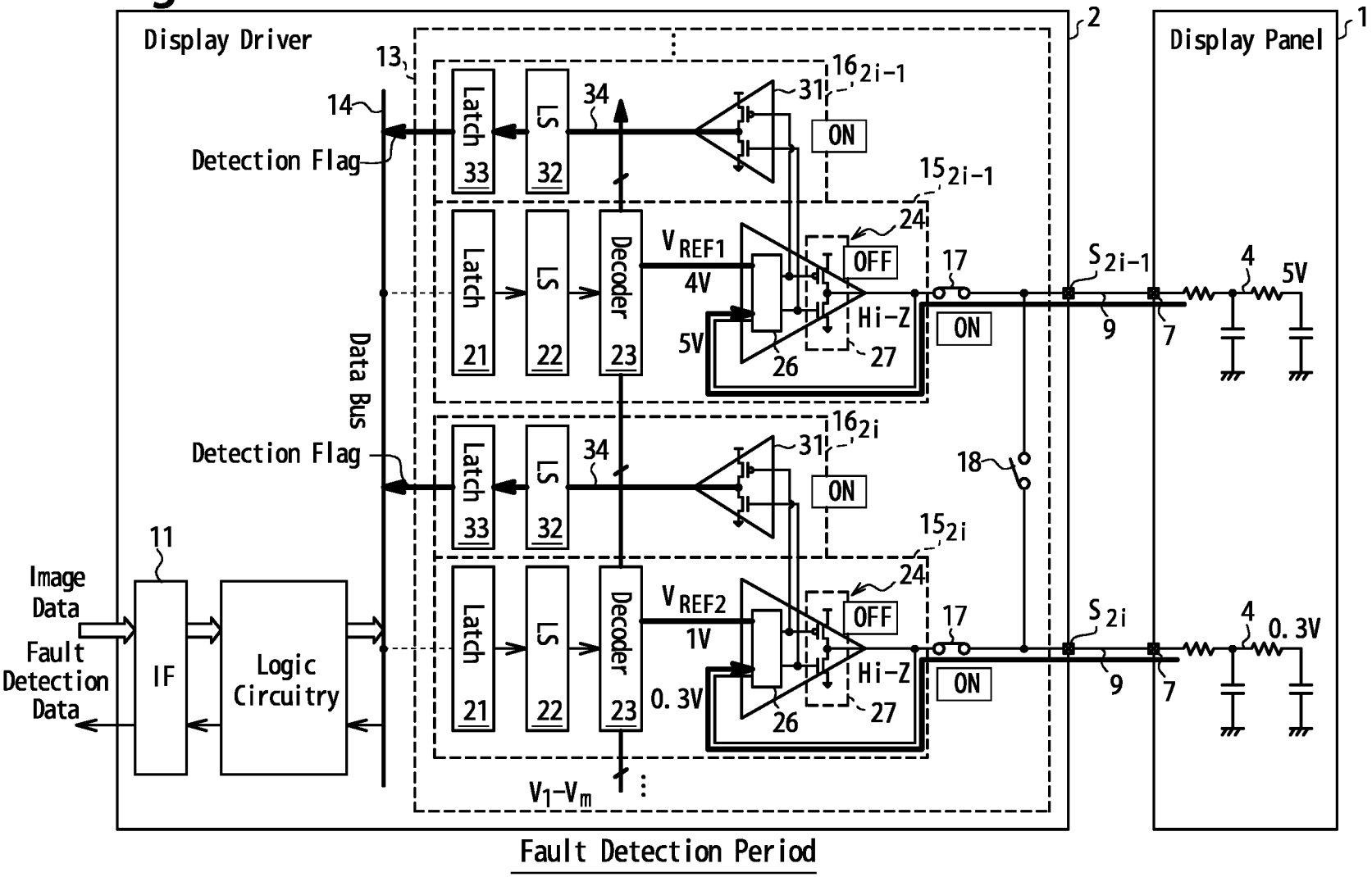
FIG. 6 illustrates one example operation of the display driver in a failure detection period, according to one or more embodiments.

Referring back to FIG. 3, in one ore embodiments, fault detection is then performed for the COF interconnections 9 and the source lines 4 in step S03. The period in which the fault detection is performed may be hereinafter referred to as fault detection period. During the fault detection period, as illustrated in FIG. 6, the output switches 17 are turned on and the outputs of the source amplifiers 24 are set to high impedance, in one or more embodiments. In one or more embodiments, the operations of the output stages 27 are stopped to thereby set the outputs of the source amplifiers 24 to high impedance during the fault detection period.

In one or more embodiments, the differential input stages 26 of the source amplifiers 24 of the output circuitries $\mathbf{15}_{2i-1}$ and $\mathbf{15}_{2i}$ are configured to compare the voltages on the external output terminals $S_{2i-1}$ and $S_{2i}$ with the reference voltages $V_{REF1}$ and $V_{REF2}$, respectively, to generate output signals based on the comparisons, during the fault detection period. In one or more embodiments, the comparison output circuitries 31 are configured to output the comparison output signals 34 based on the output signals of the differential input stages 26 during the fault detection period. In one or more embodiments, the comparison output signals 34 are based on the comparisons of the voltages on the external output terminals $S_{2i-1}$ and $S_{2i}$ with the reference voltages $V_{REF1}$ and $V_{REF2}$, respectively. In one or more embodiments, the values of the comparison output signals 34 are latched by the latches 33, and the values outputted from the latches 33 are used as the detection flags. In one or more embodiments, the detection flags outputted from the latches 33 of the test circuitries $\mathbf{16}_{2i-1}$ and $\mathbf{16}_{2i}$ are transferred to the logic circuitry 12 and used for fault detection of the COF interconnections 9 and source lines 4 connected to the external output terminals $S_{2i-1}$ and $S_{2i}$.

Figure 7:
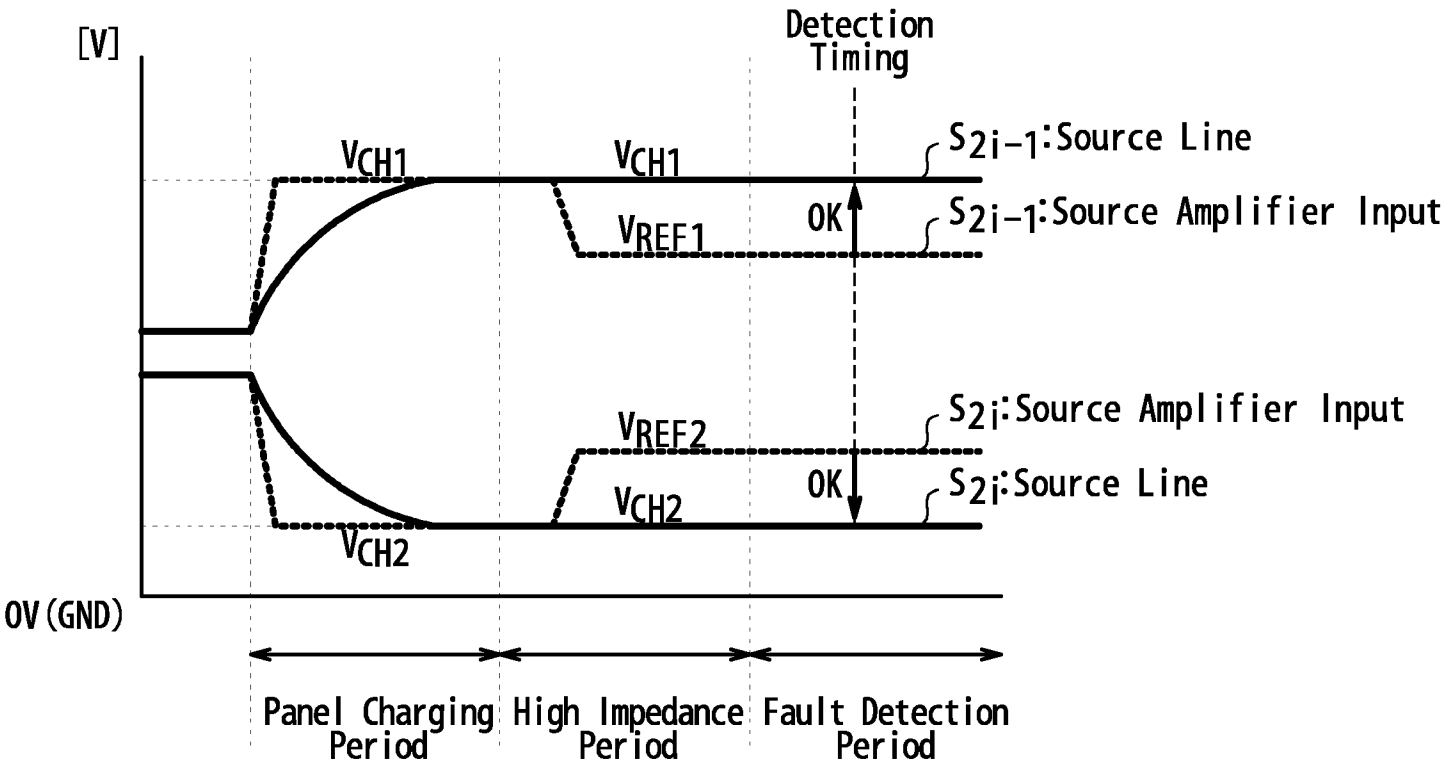
FIG. 7 illustrates one example operation of the display driver, according to one or more embodiments.

If there are no faults in the COF interconnections 9 and source lines 4 connected to the external output terminals $S_{2i-1}$ and $S_{2i}$, as illustrated in FIG. 7, the COF interconnections 9 and source lines 4 will be charged to the source output voltages $V_{CH1}$ and $V_{CH2}$, respectively, during the panel charging period, and the voltages on the COF interconnections 9 and source lines 4 remain unchanged or substantially unchanged during the following high impedance period and fault detection period. In this case, the voltage on the external $S_{2i-1}$ is higher than the reference voltage $V_{REF1}$ while the voltage on the external $S_{2i}$ is lower than the reference voltage $V_{REF2}$, and the comparison output signals 34 and detection flags are generated to reflect these comparison results during the fault detection period.

In one or more embodiments, expected values of the detection flags for the case where there are no faults in the COF interconnections 9 and source lines 4 are stored in the logic circuitry 12, and the logic circuitry 12 determines whether there are faults or no faults based on the expected values of the detection flags. For example, when the values of the detection flags received from the test circuitries $\mathbf{16}_{2i-1}$ and $\mathbf{16}_{2i}$ are equal to the stored, expected values, the logic circuitry 12 determines no fault and generates the fault detection data (or non-fault detection data) to indicate that there are no faults in the COF interconnections 9 and the source lines 4.

Figure 8:
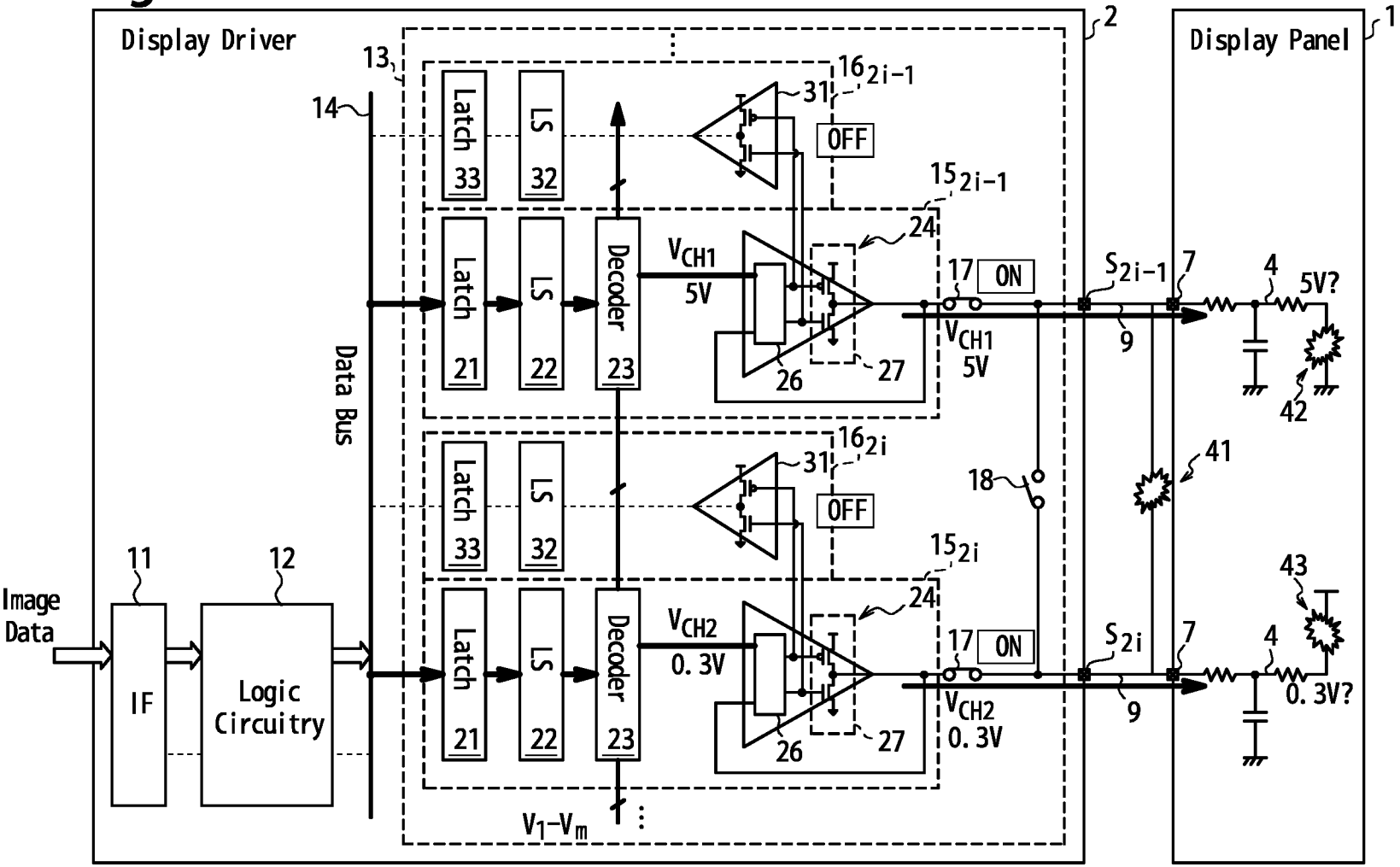
FIG. 8 illustrates one example short fault in the display module, according to one or more embodiments.
Figure 9:
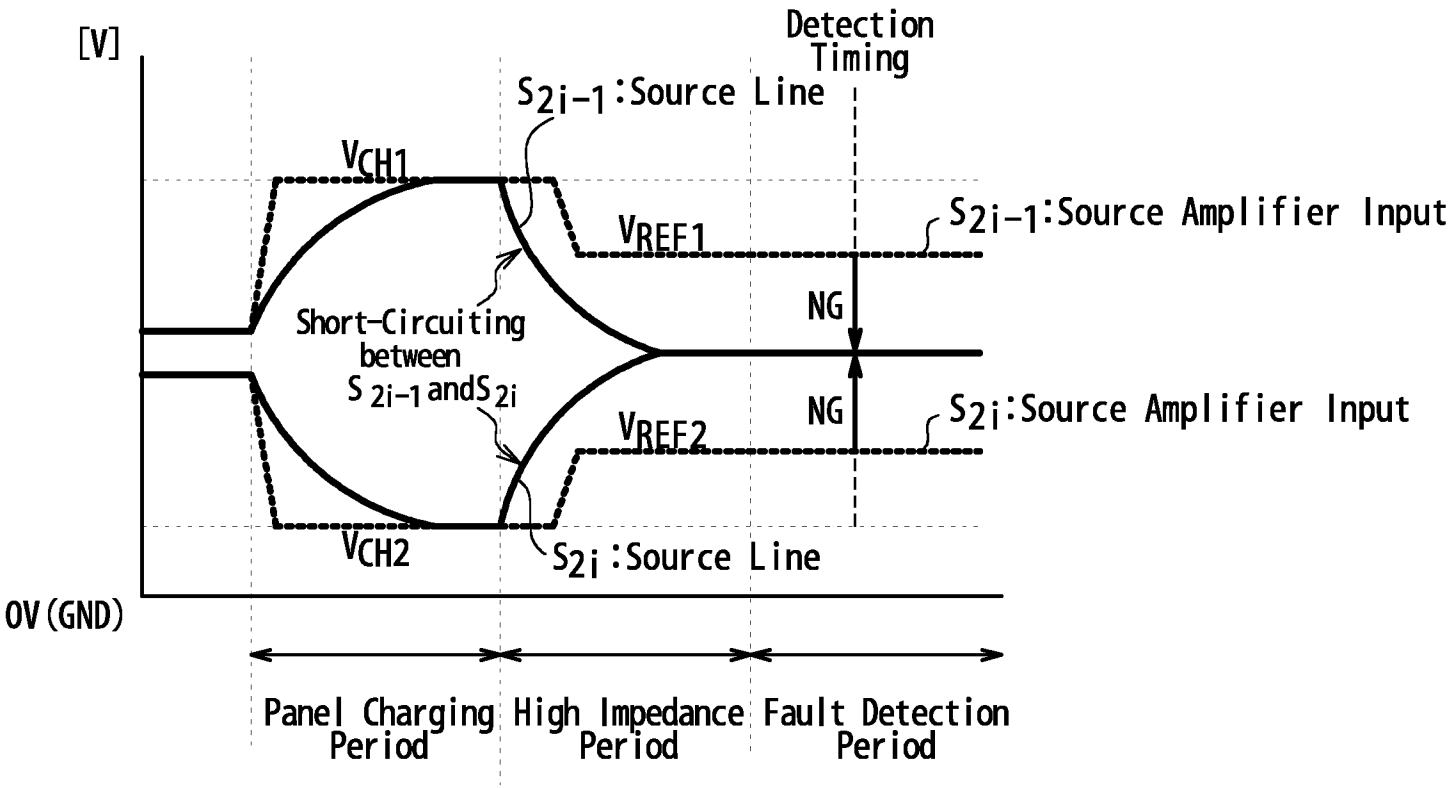
FIG. 9 illustrates one example operation of the display driver for a case when a short fault exists, according to one or more embodiments.

If there is a fault in any of the COF interconnections 9 and source lines 4, the voltages on the external output terminals $S_{2i-1}$ and $S_{2i}$ exhibit different behaviors from those illustrated in FIG. 7, and the detection flags generated by the test circuitries $\mathbf{16}_{2i-1}$ and $\mathbf{16}_{2i}$ will have values different from the expected values stored in the logic circuitry 12. For example, in case of a short fault 41 between the COF interconnections 9 and source lines 4 as illustrated in FIG. 8, the COF interconnections 9 and source lines 4 may not be charged to the source output voltages $V_{CH1}$ or $V_{CH2}$ during the panel charging period as illustrated in FIG. 9, and undesired charge sharing may occur between the COF interconnections 9 and source lines 4 during the following high impedance period, making the voltages on the COF interconnections 9 and source lines 4 equal or close to the average of the source output voltages $V_{CH1}$ and $V_{CH2}$. In this event, during the high impedance period, the voltage on the external output terminal $S_{2i-1}$ becomes lower than the reference voltage $V_{REF1}$ and the voltage on the external output terminal $S_{2i}$ becomes higher than the reference voltage $V_{REF2}$. In one or more embodiments, the voltages on the external output terminals $S_{2i-1}$ and $S_{2i}$ are then compared with the reference voltages $V_{REF1}$ and $V_{REF2}$, respectively, in the fault detection period, and the comparison output signals 34 and detection flags are generated to reflect the comparison results, which differ from the expected values.

If there is a short fault 42 which short-circuits the COF interconnection 9 and source line 4 connected to the external output terminal $S_{2i-1}$ to an interconnection of the circuit ground level, the COF interconnection 9 and source line 4 may not be charged to the source output voltages $V_{CH1}$, and the voltage on the external output terminal $S_{2i-1}$ becomes lower than the reference voltage $V_{REF1}$ during the high impedance period and the fault detection period. If there is a short fault 43 which short-circuits the COF interconnection 9 and source line 4 connected to the external output terminal $S_{2i}$ to an interconnection of the power source level, the COF interconnection 9 and source line 4 may not be charged to the source output voltages $V_{CH2}$, and the voltage on the external output terminal $S_{2i}$ becomes higher than the reference voltage $V_{REF2}$ during the high impedance period and the fault detection period.

Figure 10:
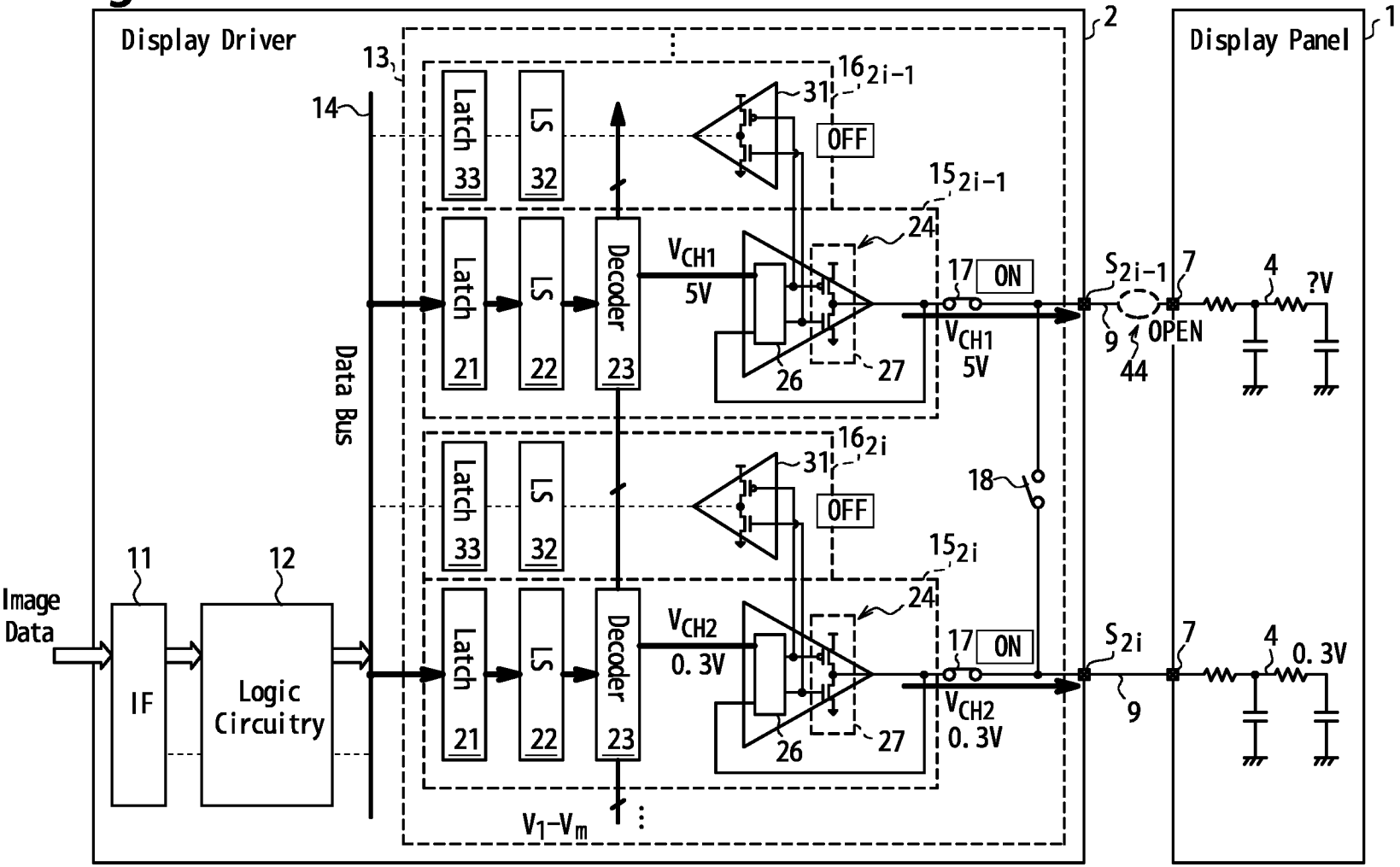
FIG. 10 illustrates one example open fault in the display module, according to one or more embodiments.
Figure 11:
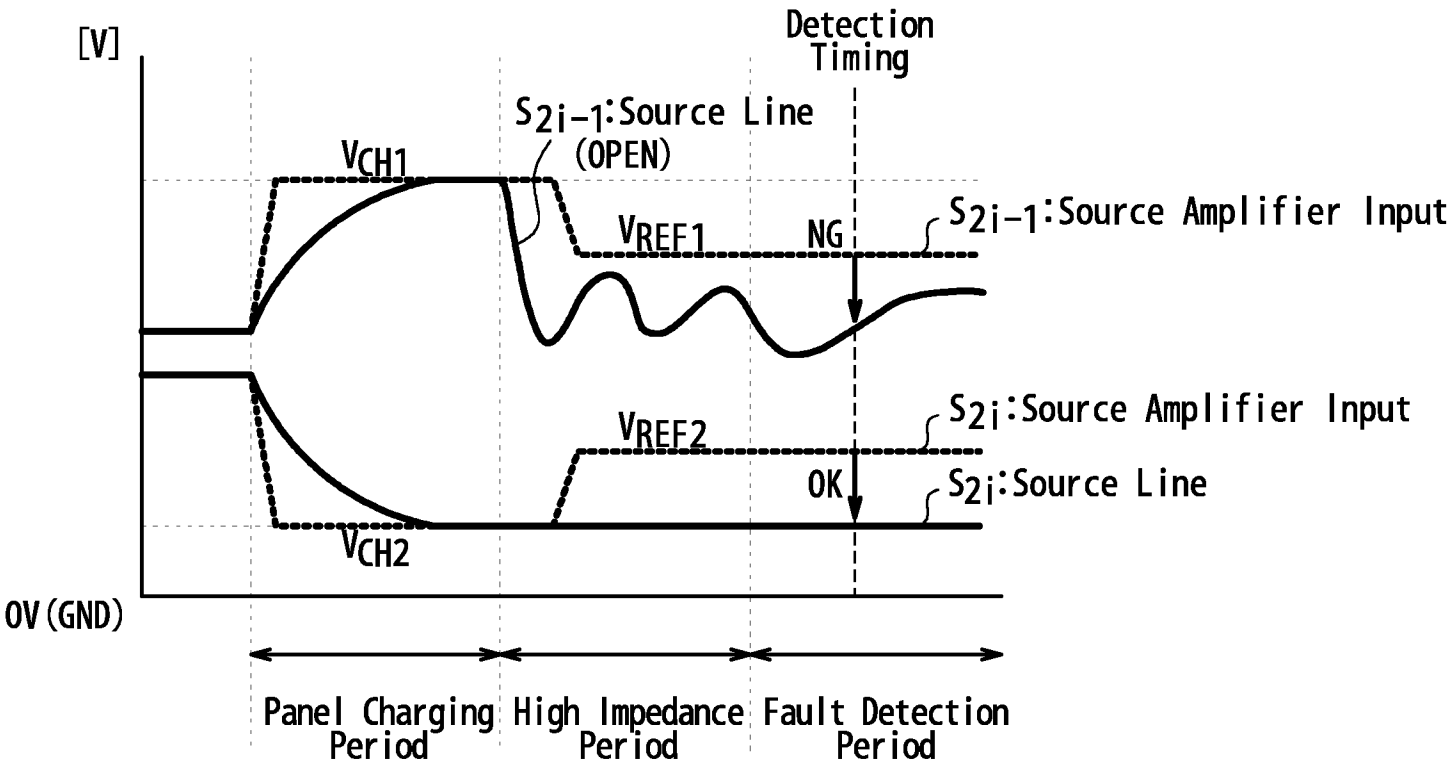
FIG. 11 illustrates one example operation of the display driver for a case when an open fault exists, according to one or more embodiments.

In case of an open fault 44 in the COF interconnection 9 connected to the external output terminal $S_{2i-1}$ as illustrated in FIG. 10, the COF interconnection 9 and source line 4 may not be charged to the source output voltage $V_{CH1}$, and the voltage level on the specific source line 4 becomes unstable during the high impedance period and the fault detection period, and the voltage on the external output terminal $S_{2i-1}$ becomes unsettled as illustrated in FIG. 11. In a similar manner to the short fault, the detection flag generated the test circuitry $\mathbf{16}_{2i-1}$ will have a different value from the expected values stored in the logic circuitry 12. In one or more embodiments, in response to such detection flags, the logic circuitry 12 generates the fault detection data, and the fault is detected.

According to other embodiments, intentional charge sharing may be used in the test sequence. The intentional charge sharing may be performed by short-circuiting each of the external output terminals S to another. After this charge sharing, the comparison output signals 34 and detection flags may be generated based on the voltages on the respective external output terminals S. In such embodiments, for example, an open fault in the COF interconnections 9 and source lines 4 connected to the external output terminals $S_{2i-1}$ and $S_{2i}$ can be detected based on the generated detection flags.

Figure 12:
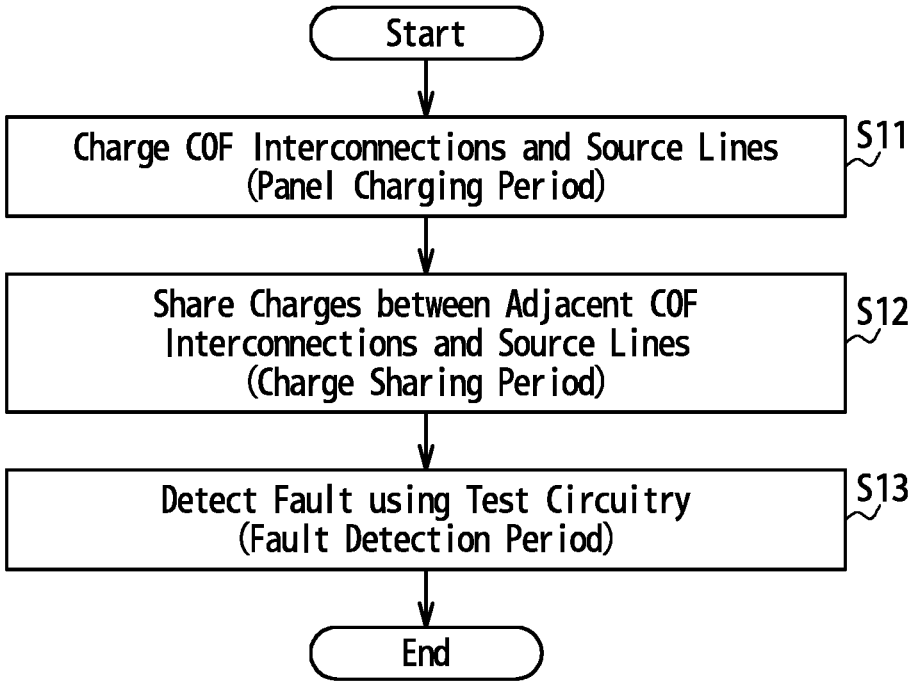
FIG. 12 is a flowchart illustrating one example test sequence, according to one or more embodiments.

In one or more embodiments, as illustrated in FIG. 12, in step S11, desired source output voltages $V_{CH1}$ and $V_{CH2}$ are outputted from the output circuitries $\mathbf{15}_{2i-1}$ and $\mathbf{15}_{2i}$ to the external output terminals $S_{2i-1}$ and $S_{2i}$ in order to charge the COF interconnections 9 and source lines 4 with the desired source output voltages during the panel charging period. This charging is performed in a similar manner to the above-described charging during step S01 of FIG. 3.

Figure 13:
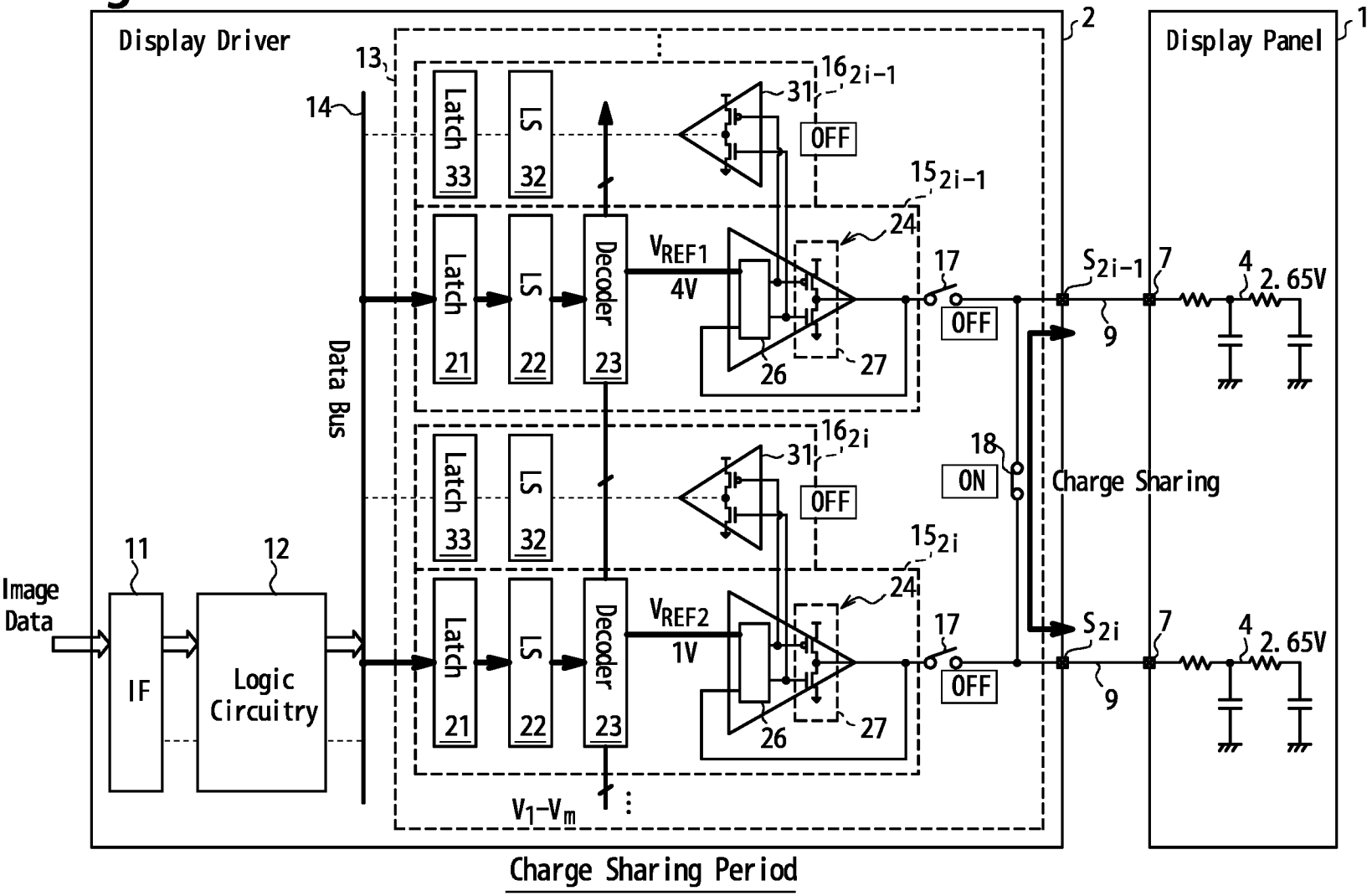
FIG. 13 illustrates one example operation of the display driver in a charge sharing period, according to one or more embodiments.

In step S12, charge sharing is then performed between the COF interconnections 9 and source lines 4 connected to the adjacent external output terminals $S_{2i-1}$ and $S_{2i}$. The period during which the charge sharing is performed may be hereinafter referred to as "charge sharing period." In some embodiments, as illustrated in FIG. 13, the output switches 17 are turned off and the short-circuit switches 18 are turned on during the charge sharing period. If there are no faults in the COF interconnections 9 and source lines 4, the voltages on the COF interconnections 9 and source lines 4 will be equal or close to the average of the source output voltages $V_{CH1}$ and $V_{CH2}$ outputted in step S11 upon the turn-on of the short-circuit switches 18. As one example, when the source output voltage $V_{CH1}$ of 5V is outputted to the external output terminal $S_{2i-1}$ and the source output voltage $V_{CH2}$ of 0.3V is outputted to the external output terminal $S_{2i}$, the COF interconnections 9 and source lines 4 connected to both the external output terminals $S_{2i-1}$ and $S_{2i}$ become 2.65V.

Further in step S12, reference voltages $V_{REF1}$ and $V_{REF2}$ are supplied from the decoders 23 to the source amplifiers 24 in the output circuitries $\mathbf{15}_{2i-1}$ and $\mathbf{15}_{2i}$. The reference voltages $V_{REF1}$ and $V_{REF2}$ are referred to during the fault detection period in the next step S13. In one or more embodiments, the reference voltages $V_{REF1}$ and $V_{REF2}$ are determined based on expected variations in the voltage on the COF interconnections 9 and source lines 4 for the case where the COF interconnections 9 and source lines 4 are free from faults. In one or more embodiments, the reference voltage $V_{REF1}$ is set to a voltage level between the source output voltage $V_{CH1}$ and the average of the source output voltages $V_{CH1}$ and $V_{CH2}$, and the reference voltage $V_{REF2}$ is set to a voltage level between the source output voltage $V_{CH2}$ and the average of the source output voltages $V_{CH1}$ and $V_{CH2}$. As one example, when the source output voltage $V_{CH1}$ of 5V is supplied to the external output terminal $S_{2i-1}$ and the source output voltage $V_{CH2}$ of 0.3V is supplied to the external output terminal $S_{2i}$, the reference voltages $V_{REF1}$ and $V_{REF2}$ are set to 4V and 1V, respectively.

Figure 14:
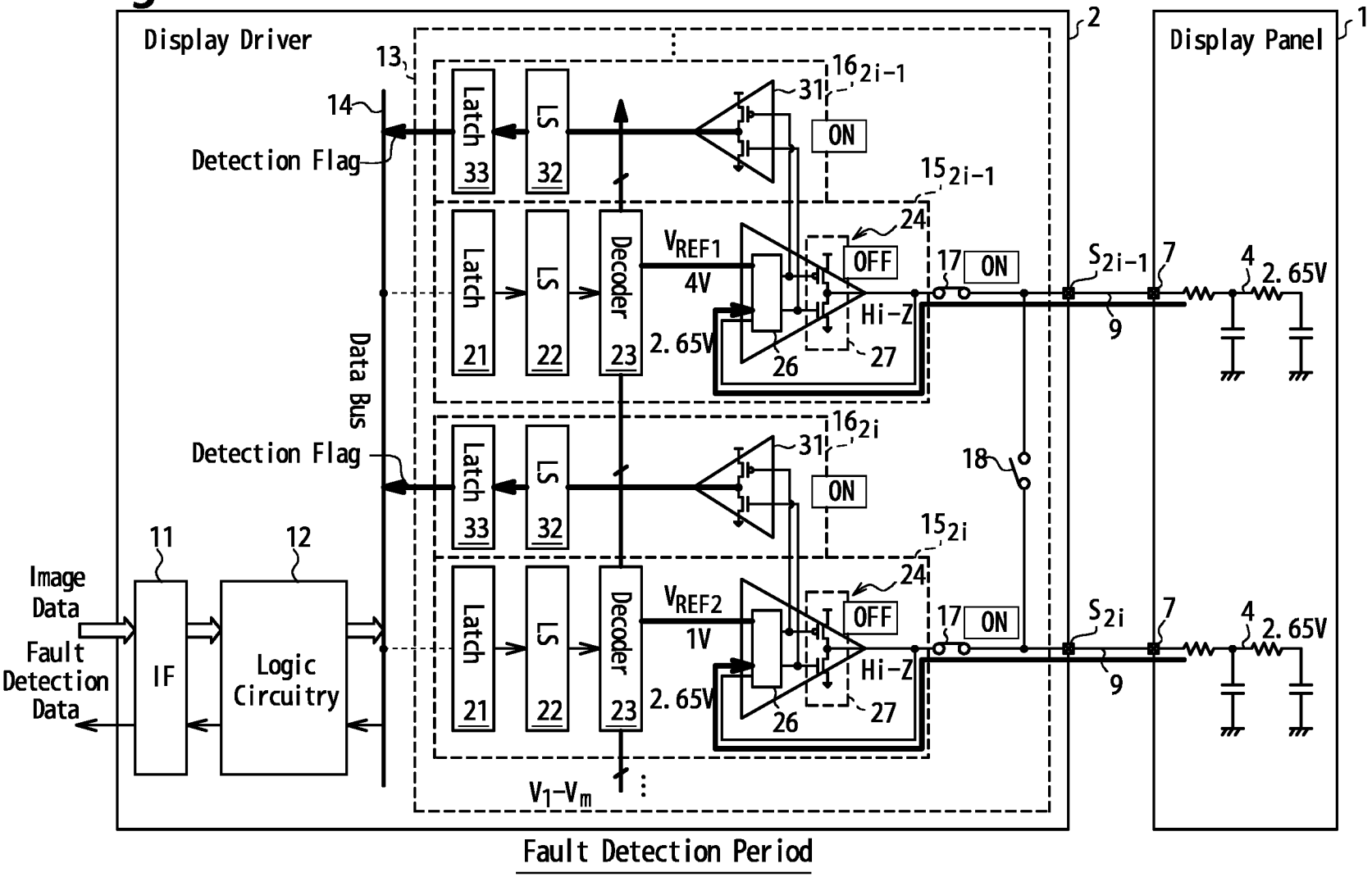
FIG. 14 illustrates one example operation of the display driver in a fault detection period, according to one or more embodiments.

In step S13, the fault detection is then performed for the COF interconnections 9 and the source lines 4. As illustrated in FIG. 14, in one or more embodiments, the output switches 17 are turned on and the short-circuit switches 18 are turned off during the fault detection period. In one or more embodiments, the operations of the output stages 27 are stopped to thereby set the outputs of the source amplifiers 24 to high impedance.

In one or more embodiments, the differential input stages 26 of the source amplifiers 24 of the output circuitries $\mathbf{15}_{2i-1}$ and $\mathbf{15}_{2i}$ are configured to compare the voltages on the external output terminals $S_{2i-1}$ and $S_{2i}$ with the reference voltages $V_{REF1}$ and $V_{REF2}$, respectively, in the fault detection period, and the comparison output circuitries 31 are configured to output the comparison output signals 34 based on the comparisons of the voltages on the external output terminals $S_{2i-1}$ and $S_{2i}$ with the reference voltages $V_{REF1}$ and $V_{REF2}$. In one or more embodiments, the values of the comparison output signals 34 are latched by the latches 33, and the values outputted from the latches 33 are used as the detection flags. In one or more embodiments, the detection flags outputted from the latches 33 of the test circuitries $\mathbf{16}_{2i-1}$ and $\mathbf{16}_{2i}$ are transferred to the logic circuitry 12 and used for fault detection of the COF interconnections 9 and source lines 4 connected to the external output terminals $S_{2i-1}$ and $S_{2i}$.

Figure 15:
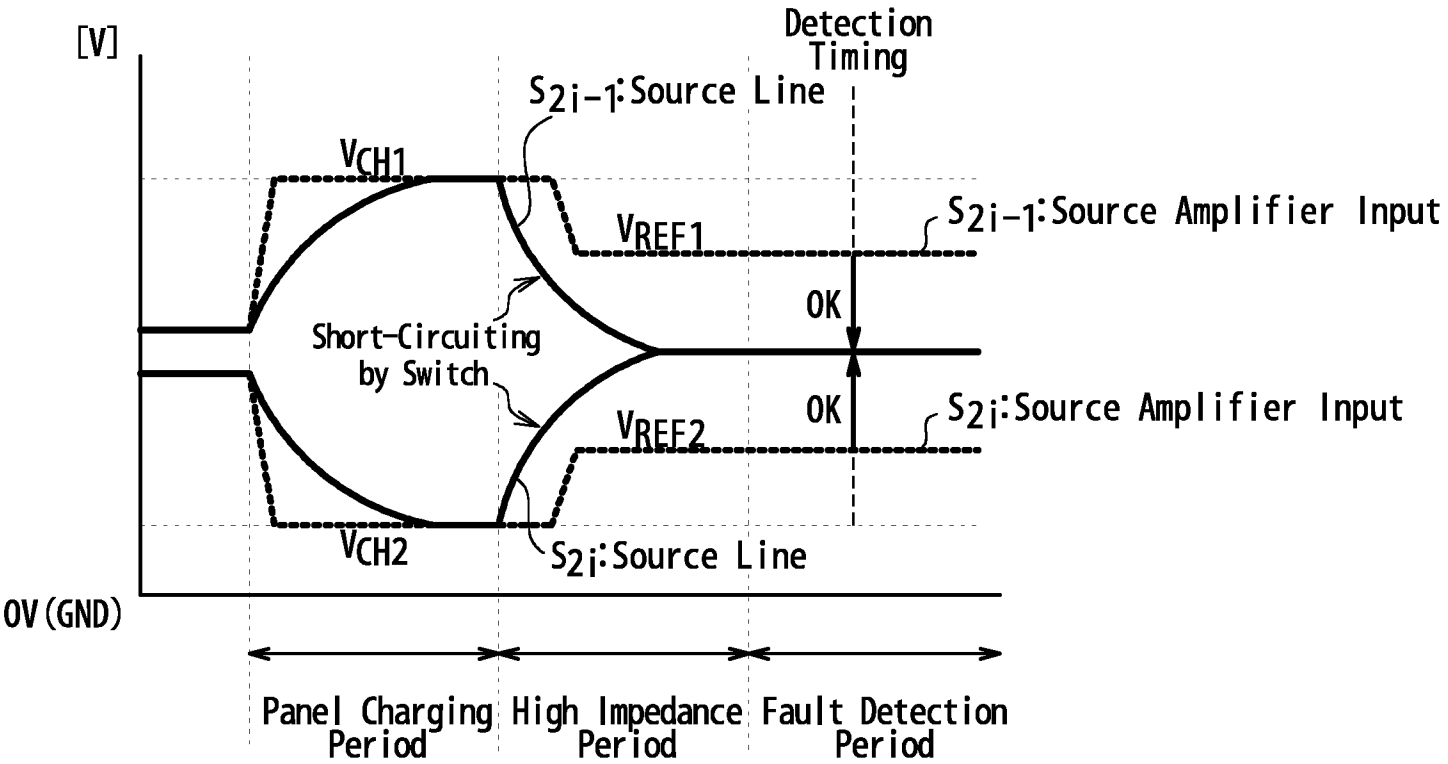
FIG. 15 illustrates one example operation of the display driver, according to one or more embodiments.

When there are no faults in the COF interconnections 9 and source lines 4 connected to the external output terminals $S_{2i-1}$ and $S_{2i}$, in one or more embodiments, the COF interconnections 9 and source lines 4 connected to the external output terminals $S_{2i-1}$ and $S_{2i}$ are charged to the source output voltages $V_{CH1}$ and $V_{CH2}$, respectively, during the panel charging period as illustrated in FIG. 15. In one or more embodiments, the external output terminal $S_{2i-1}$ and $S_{2i}$ are short-circuited by the short-circuit switch 18 connected therebetween during the following charge sharing period, and this results in that the voltages on the COF interconnections 9 and source lines 4 connected to the external output terminal $S_{2i-1}$ and $S_{2i}$ become the average of the source output voltages $V_{CH1}$ and $V_{CH2}$. In one or more embodiments, during the fault detection period, the voltage on the external $S_{2i-1}$ is lower than the reference voltage $V_{REF1}$ while the voltage on the external $S_{2i}$ is higher than the reference voltage $V_{REF2}$. In one or more embodiments, the comparison output signals 34 and detection flags are generated to reflect these comparison results.

In one or more embodiments, expected values of the detection flags for the case where there are no faults in the COF interconnections 9 and source lines 4 are stored in the logic circuitry 12, and the logic circuitry 12 determines that there are no faults in the COF interconnections 9 and the source lines 4 connected to the external outputs $S_{2i-1}$ and $S_{2i}$ when the values of the detection flags received from the test circuitries $\mathbf{16}_{2i-1}$ and $\mathbf{16}_{2i}$ are equal to the expected values. In this case, the logic circuitry 12 generates fault detection data to indicate that there are no faults in the COF interconnections 9 and the source lines 4 connected to the external outputs $S_{2i-1}$ and $S_{2i}$ in one or more embodiments.

When there is an open fault in any of the COF interconnections 9 and source lines 4 connected to the external output terminals $S_{2i-1}$ and $S_{2i}$ in one or more embodiments, the voltages on the external output terminals $S_{2i-1}$ and $S_{2i}$ exhibit different behaviors from those illustrated in FIG. 15. This results in that the detection flags are generated to have values different from the expected values and outputted from the test circuitries $\mathbf{16}_{2i-1}$ and $\mathbf{16}_{2i}$, in one or more embodiments.

Figure 16:
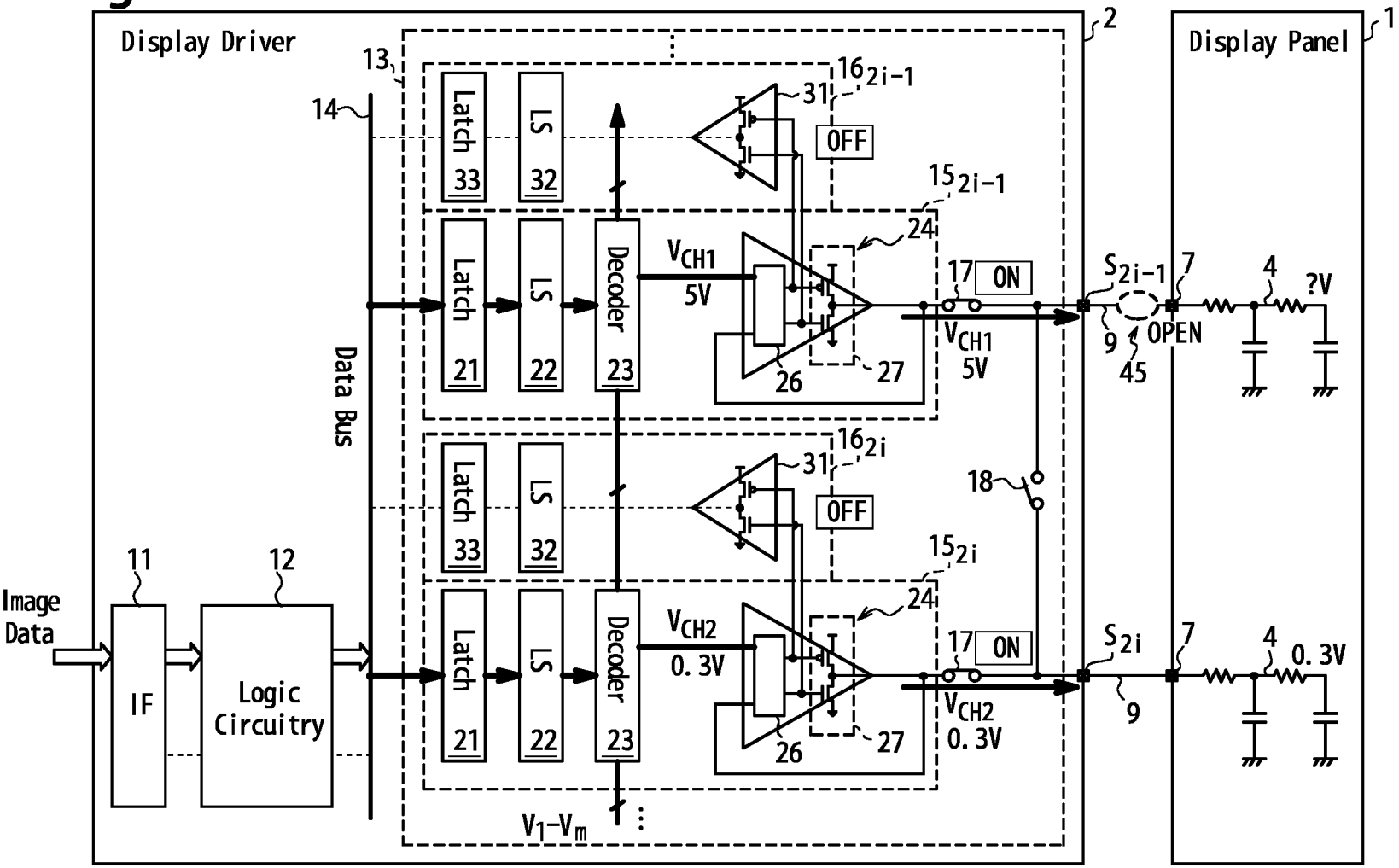
FIG. 16 illustrates one example open fault in the display module, according to one or more embodiments.
Figure 17:
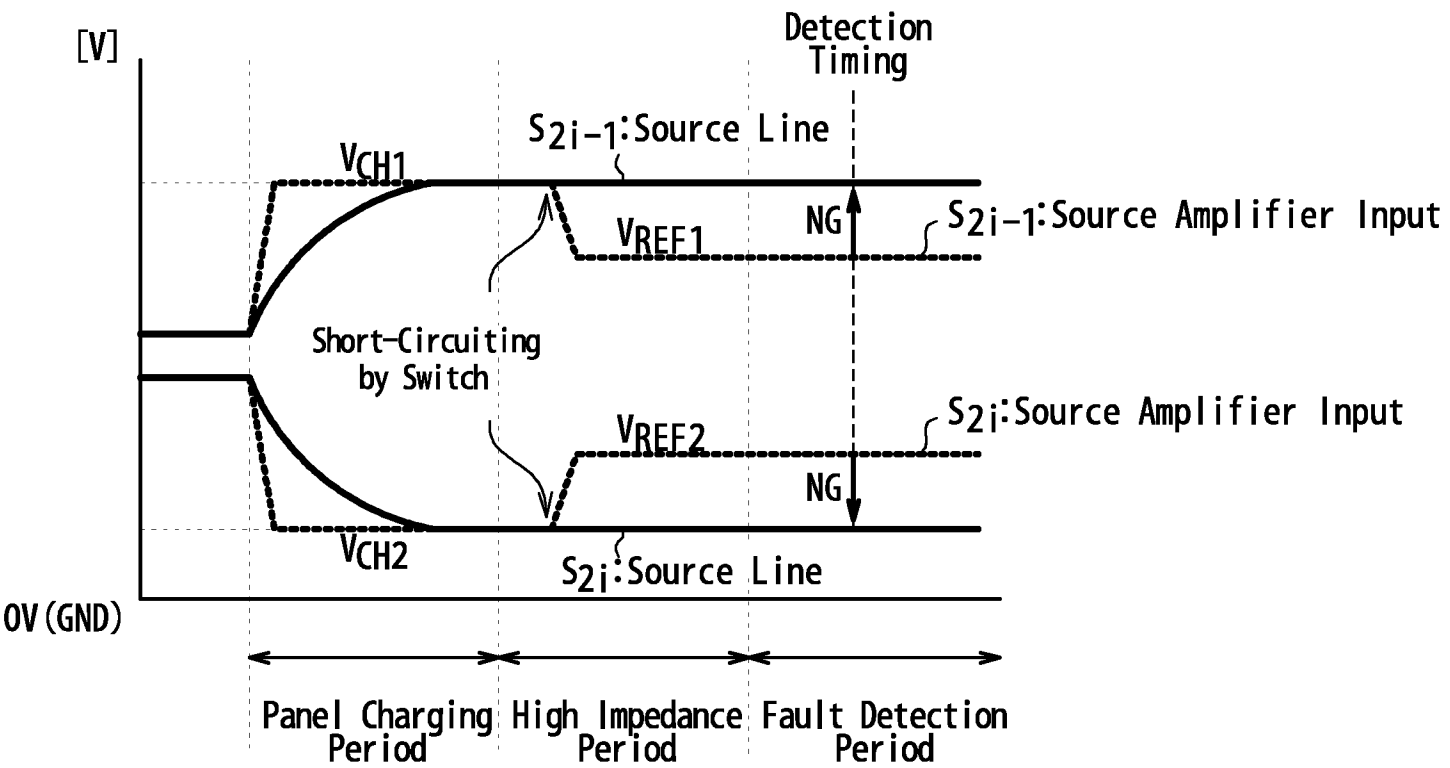
FIG. 17 illustrates one example operation of the display driver for a case when an open fault exists, according to one or more embodiments.

In one or more embodiments, when there is an open fault 45 in the COF interconnection 9 connected to the external output terminal $S_{2i-1}$ as illustrated in FIG. 16, the COF interconnection 9 and source line 4 is not charged to the source output voltage $V_{CH1}$ during the panel charging period. In such embodiments, charge sharing is not achieved between the source lines 4 connected to the external output terminals $S_{2i-1}$ and $S_{2i}$ in the following charge sharing period as illustrated in FIG. 17. In one or more embodiments, during the following fault detection period, the voltage on the external output terminal $S_{2i-1}$ is higher than the reference voltage $V_{REF1}$, and the voltage on the external output terminal $S_{2i}$ is lower than the reference voltage $V_{REF2}$. This results in that the detection flags are generated to have different values from the expected values in the test circuitries $\mathbf{16}_{2i-1}$ and $\mathbf{16}_{2i}$, in one or more embodiments.

In one or more embodiments, when the detection flags are generated to have different values from the expected values in the test circuitries $\mathbf{16}_{2i-1}$ and $\mathbf{16}_{2i}$, the logic circuitry 12 generates the fault detection data to indicate that there is an open fault in the COF interconnections 9 and source lines 4 connected to the external output terminal $S_{2i-1}$ or $S_{2i}$.

In one or more embodiments, each external output terminal S is short-circuited to another external output terminal S other than its adjacent external output terminals S to achieve charge sharing in a test sequence to detect open faults, and fault detection is performed based on the voltages on the respective external output terminals S after the charge sharing. In one or more embodiments, such a test sequence is applied to a case where one of the adjacent output circuitries $\mathbf{15}_{2i-1}$ and $\mathbf{15}_{2i}$ is dedicated for outputting positive source output voltages, and the other is dedicated for outputting negative source output voltages.

Figure 18:
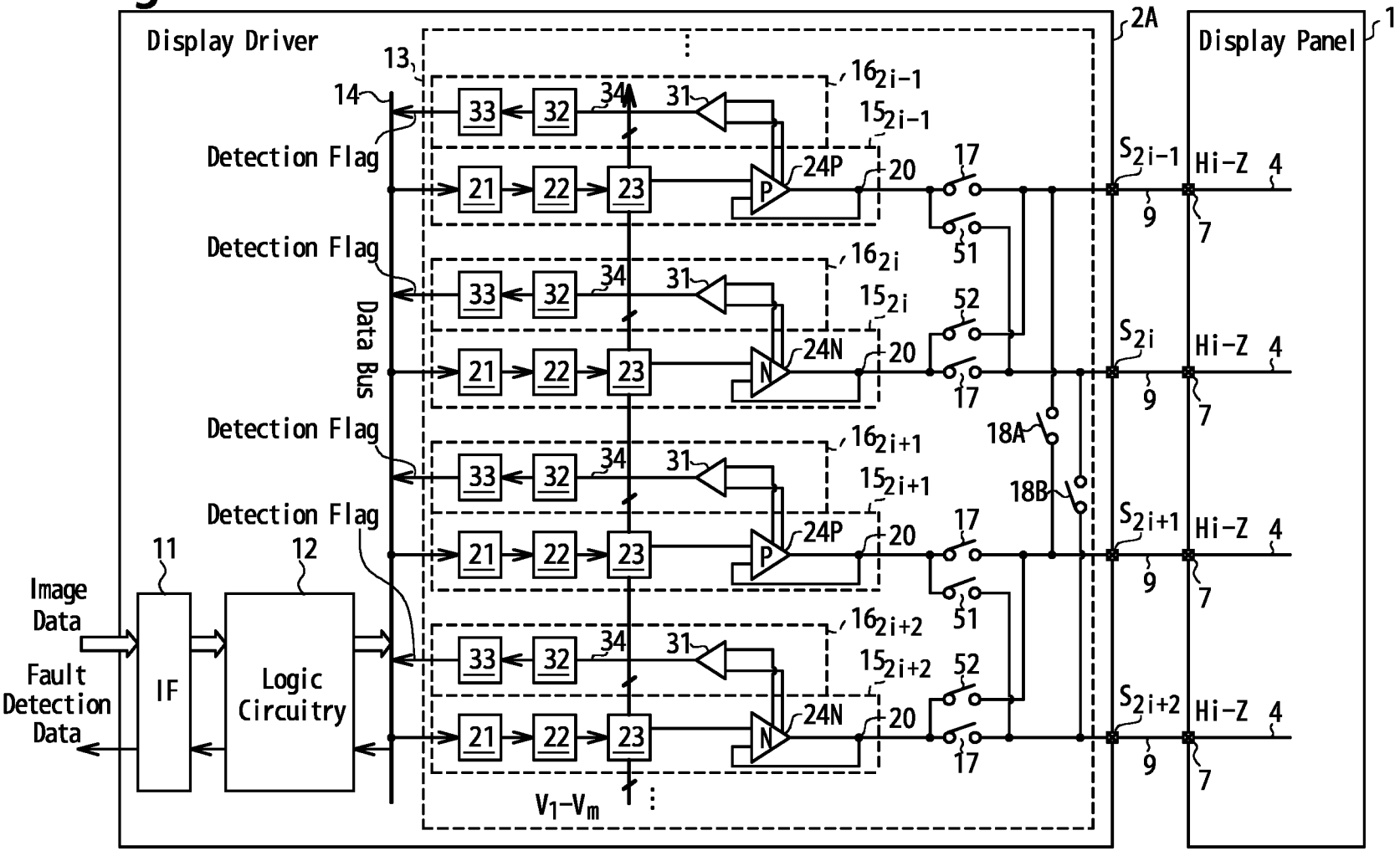
FIG. 18 illustrates one example configuration of a display driver, according to one or more embodiments.

In one or more embodiments, as illustrated in FIG. 18, odd-numbered output circuitries $\mathbf{15}_{2i-1}$ and $\mathbf{15}_{2i+1}$ of the display driver, which is denoted by numeral 2A in FIG. 18, each comprise a positive-side source amplifier 24P configured to output a source output voltage of a first polarity, for example, a positive source output voltage, and even-numbered output circuitries $\mathbf{15}_{2i}$ and $\mathbf{15}_{2i+2}$ each comprise a negative-side source amplifier 24N configured to output a source output voltage of a second polarity different from the first polarity, for example, a negative source output voltage. In one or more embodiments, the positive-side source amplifier 24P is dedicated for outputting positive source output voltages, lacking an ability to output a negative source output voltage. In one or more embodiments, the negative-side source amplifier 24N is dedicated for outputting negative source output voltages, lacking an ability to output a positive source output voltage.

In one or more embodiments, cross switches 51 are disposed between the outputs of the positive-side source amplifiers 24P of the odd-numbered output circuitries $\mathbf{15}_{2i-1}$ and $\mathbf{15}_{2i+1}$ and the even-numbered external output terminals $S_{2i}$ and $S_{2i+2}$, and cross switches 52 are disposed between the outputs of the negative-side source amplifiers 24N of the even-numbered output circuitries $\mathbf{15}_{2i}$ and $\mathbf{15}_{2i+2}$ and the odd-numbered external output terminals $S_{2i-1}$ and $S_{2i+1}$. In one or more embodiments, a short-circuit switch 18A is connected between the odd-numbered external output terminal $S_{2i-1}$ and $S_{2i}$, and a short-circuit switch 18B is connected between the even-numbered external output terminal $S_{2i}$ and $S_{2i+2}$. In one or more embodiments, the rest of the display driver 2A illustrated in FIG. 18 is configured similarly to the display driver 2 illustrated in FIG. 2.

In one or more embodiments, the display driver 2A illustrated in FIG. 18 is used in a case where an LCD panel is used as the display panel 1. In one or more embodiments, when positive source output voltages are supplied to the source lines 4 connected to the odd-numbered external output terminals $S_{2i-1}$ and $S_{2i+1}$ and negative source output voltages are supplied to the source lines 4 connected to the even-numbered external output terminals $S_{2i}$ and $S_{2i+2}$, the output switches 17 are turned on and the cross switches 51 and 52 are turned off. In one or more embodiments, when negative source output voltages are supplied to the source lines 4 connected to the odd-numbered external output terminals $S_{2i-1}$ and $S_{2i+1}$ and positive source output voltages are supplied to the source lines 4 connected to the even-numbered external output terminals $S_{2i}$ and $S_{2i+2}$, the output switches 17 are turned off and the cross switches 51 and 52 are turned on.

In one or more embodiments, a fault in the COF interconnections 9 and source lines 4 is detected through a test sequence similar to the above-described test sequence with respect to the display driver 2A illustrated in FIG. 18.

Figure 19:
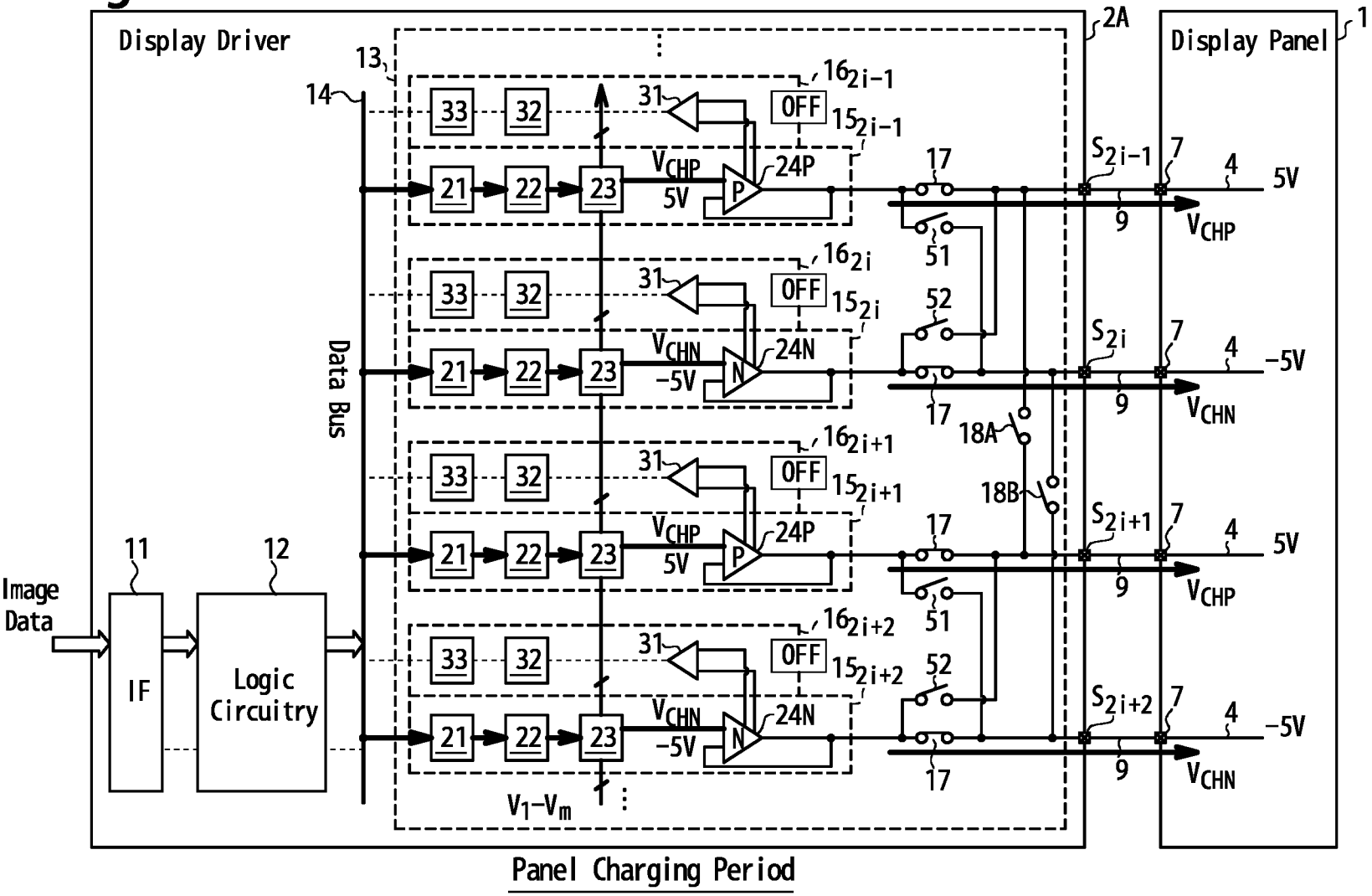
FIG. 19 illustrates one example operation of the display driver in a panel charging period, according to one or more embodiments.

In one or more embodiments, as illustrated in FIG. 19, adjacent source lines 4 are charged with different source output voltages during the panel charging period. In one or more embodiments, the output switches 17 are turned on and the cross switches 51, 52 and short-circuit switches 18A and 18B are turned off, during the panel charging period. This allows outputting desired source output voltages to the COF interconnections 9 and source lines 4 from the respective source amplifiers 24. In one or more embodiments, adjacent source lines 4 are charged with source output voltages of opposite polarities with a same absolute value. Illustrated in FIG. 19 is one example operation in which source output voltages $V_{CHP}$ of +5V are outputted to the odd-numbered external output terminals $S_{2i-1}$ and $S_{2i+1}$ and source output voltages $V_{CHN}$ of −5V are outputted to the even-numbered external output terminals $S_{2i}$ and $S_{2i+2}$.

Figure 20:
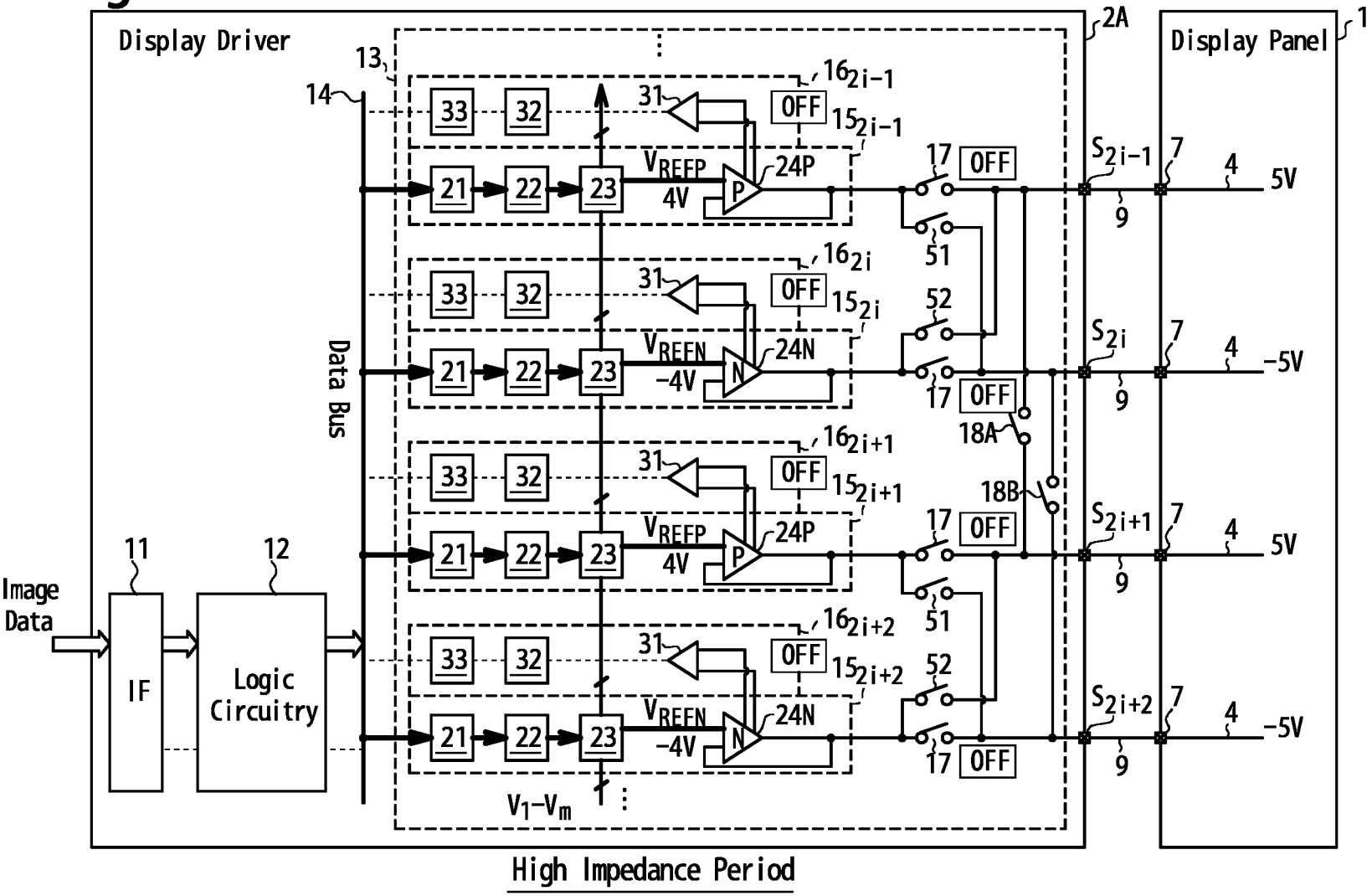
FIG. 20 illustrates one example operation of the display driver in a high impedance period, according to one or more embodiments.

In one or more embodiments, as illustrated in FIG. 20, the output switches 17, the cross switches 51, 52 and the short-circuit switches 18A and 18B are then turned off to set the COF interconnections 9 and the source lines 4 to high impedance during the high impedance period. In one or more embodiments, in the high impedance period, reference voltages $V_{REFP}$ start to be supplied from the decoders 23 to the positive-side source amplifiers 24P in the output circuitries $\mathbf{15}_{2i-1}$ and $\mathbf{15}_{2i+1}$, and reference voltages $V_{REFN}$ start be supplied from the decoders 23 to the negative-side source amplifiers 24N in the output circuitries $\mathbf{15}_{2i}$ and $\mathbf{15}_{2i+2}$. The reference voltages $V_{REFP}$ and $V_{REFN}$ are determined based on expected variations in the voltage on the COF interconnections 9 and source lines 4 for a case where the COF interconnections 9 and source lines 4 are free from faults. When source output voltages $V_{CHP}$ of +5V are outputted to the odd-numbered external output terminals $S_{2i-1}$ and $S_{2i+1}$ during the panel charging period and source output voltages $V_{CHN}$ of −5V are outputted to the even-numbered external output terminals $S_{2i}$ and $S_{2i+2}$, in one or more embodiments, the reference voltage $V_{REFP}$ is set to 4V, and the reference voltage $V_{REFN}$ is set to −4V.

Figure 21:
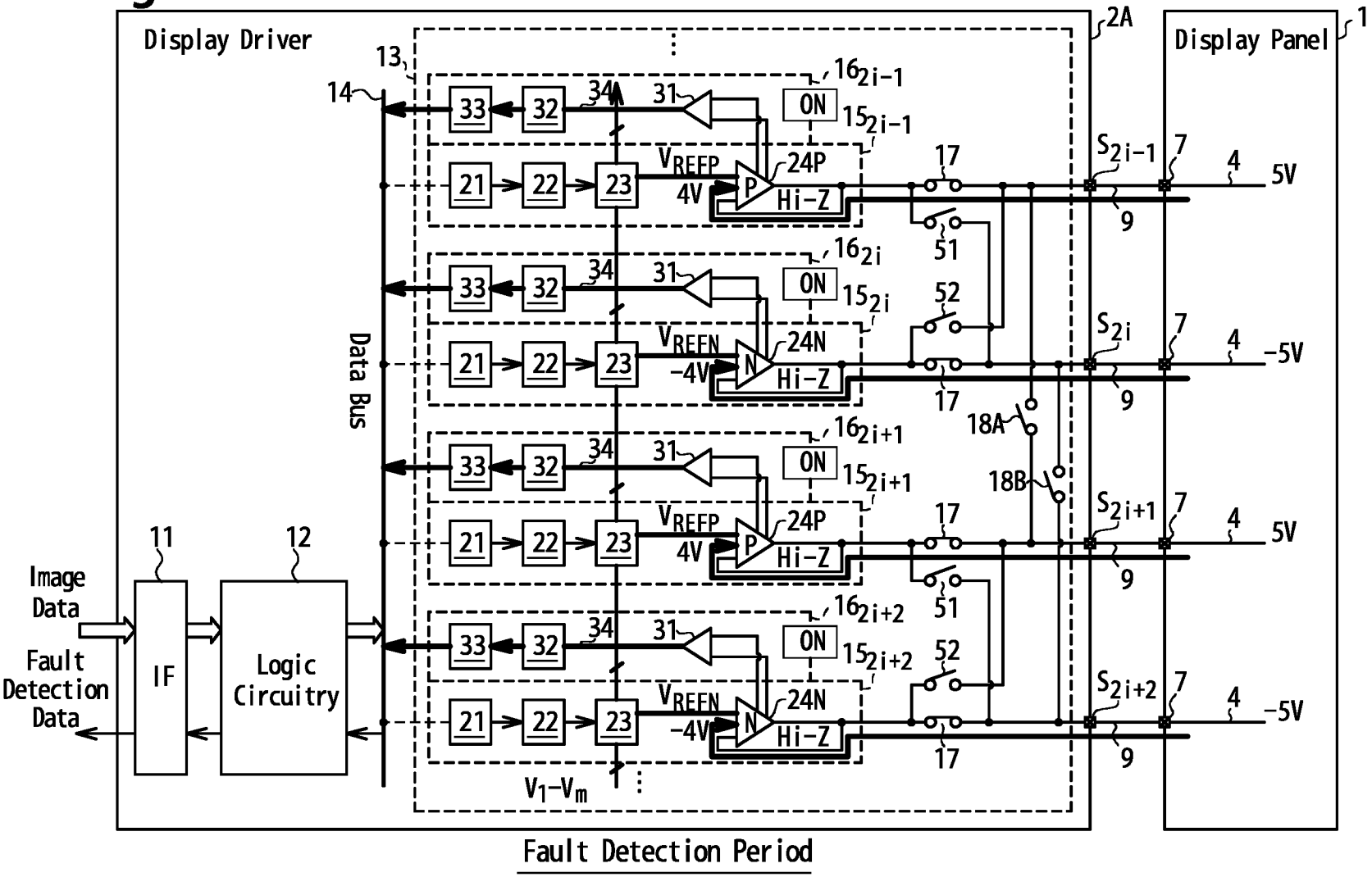
FIG. 21 illustrates one example operation of the display driver in a fault detection period, according to one or more embodiments.

In one or more embodiments, as illustrated in FIG. 21, fault detection is then performed for the COF interconnections 9 and the source lines 4 in the fault detection period. In one or more embodiments, during the fault detection period, the output switches 17 are turned on and the outputs of the positive-side and negative-side source amplifiers 24P and 24N are set to high impedance. In one or more embodiments, during the fault detection period, the differential input stages (not illustrated) of the positive-side source amplifiers 24P of the output circuitries $\mathbf{15}_{2i-1}$ and $\mathbf{15}_{2i+1}$ generate output signals based on comparisons between the reference voltages $V_{REFP}$ and the voltages on the external output terminals $S_{2i-1}$ and $S_{2i+1}$, and the differential input stages (not illustrated) of the negative-side source amplifiers 24N of the output circuitries $\mathbf{15}_{2i}$ and $\mathbf{15}_{2i+2}$ generate output signals based on comparisons between the reference voltages $V_{REFN}$ and the voltages on the external output terminals $S_{2i}$ and $S_{2i+2}$.

In one or more embodiments, the comparison output circuitry 31 of each output circuitry 15 outputs a comparison output signal 34 based on the output signals of the differential input stage of the positive-side or negative-side source amplifier 24P or 24N during the fault detection period. In one or more embodiments, the comparison output signals 34 generated in the output circuitries $\mathbf{15}_{2i-1}$ and $\mathbf{15}_{2i+1}$ reflect the comparison results between the reference voltages $V_{REFP}$ and the voltages on the external output terminals $S_{2i-1}$ and $S_{2i+1}$, and the comparison output signals 34 generated in the output circuitries $\mathbf{15}_{2i}$ and $\mathbf{15}_{2i+2}$ reflect the comparison results between the reference voltages $V_{REFN}$ and the voltages on the external output terminals $S_{2i}$ and $S_{2i+2}$. In one or more embodiments, the values of the comparison output signals 34 are latched by the latches 33, and the values outputted from the latches 33 are used as the detection flags. In one or more embodiments, the detection flags outputted from the latches 33 of the test circuitries $\mathbf{16}_{2i-1}$, $\mathbf{16}_{2i}$, $\mathbf{16}_{2i+1}$, and $\mathbf{16}_{2i+2}$ are transferred to the logic circuitry 12 and used for fault detection of the COF interconnections 9 and source lines 4 connected to the external output terminals $S_{2i-1}$, $S_{2i}$, $S_{2i+1}$, and $S_{2i+2}$.

In one or more embodiments, charge sharing through the short-circuit switches 18A and 18B is performed in a test sequence to detect an open fault in the COF interconnections 9 and the source lines 4.

Figure 22:
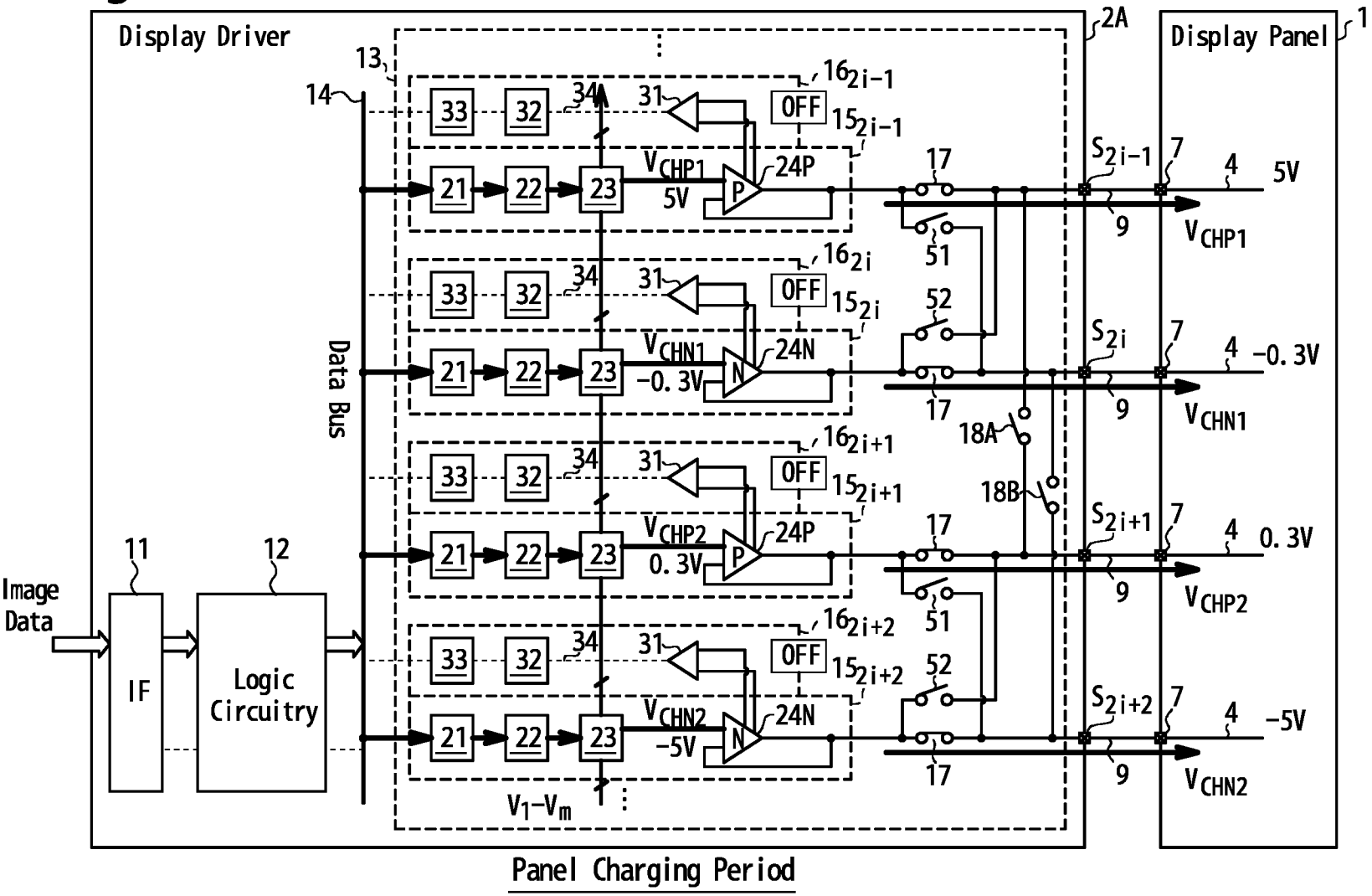
FIG. 22 illustrates one example operation of the display driver in a panel charging period, according to one or more embodiments.

In this case, as illustrated in FIG. 22, the source lines 4 connected to the odd-numbered external output terminals $S_{2i-1}$ and $S_{2i+1}$ are charged with different positive source output voltages $V_{CHP1}$ and $V_{CHP2}$ during the panel charging period, and the source lines 4 connected to the even-numbered external output terminals $S_{2i}$ and $S_{2i+2}$ are charged with different negative source output voltages $V_{CHN1}$ and $V_{CHN2}$, in one or more embodiments. In one or more embodiments, the output switches 17 are turned on and the cross switches 51, 52 and the short-circuit switches 18A and 18B are turned off, during the panel charging period. In one or more embodiments, desired positive source output voltages $V_{CHP1}$ and $V_{CHP2}$ are respectively outputted from the positive-side source amplifiers 24P to the COF interconnections 9 and source lines 4 connected to the external output terminals $S_{2i-1}$ and $S_{2i+1}$ during the panel charging period. In one or more embodiments, desired negative source output voltages $V_{CHN1}$ and $V_{CHN2}$ are respectively outputted from the negative-side source amplifiers 24N to the COF interconnections 9 and source lines 4 connected to the external output terminals $S_{2i}$ and $S_{2i+2}$ during the panel charging period. In one or more embodiments, the source output voltages $V_{CHP1}$ and $V_{CHP2}$ outputted to the odd-numbered external output terminals $S_{2i-1}$ and $S_{2i+1}$ have voltage levels of +5V and +0.3V, respectively. In one or more embodiments, the source output voltages $V_{CHN1}$ and $V_{CHN2}$ outputted to the even-numbered external output terminals $S_{2i}$ and $S_{2i+2}$ have voltage levels of −5V and −0.3V, respectively.

Figure 23:
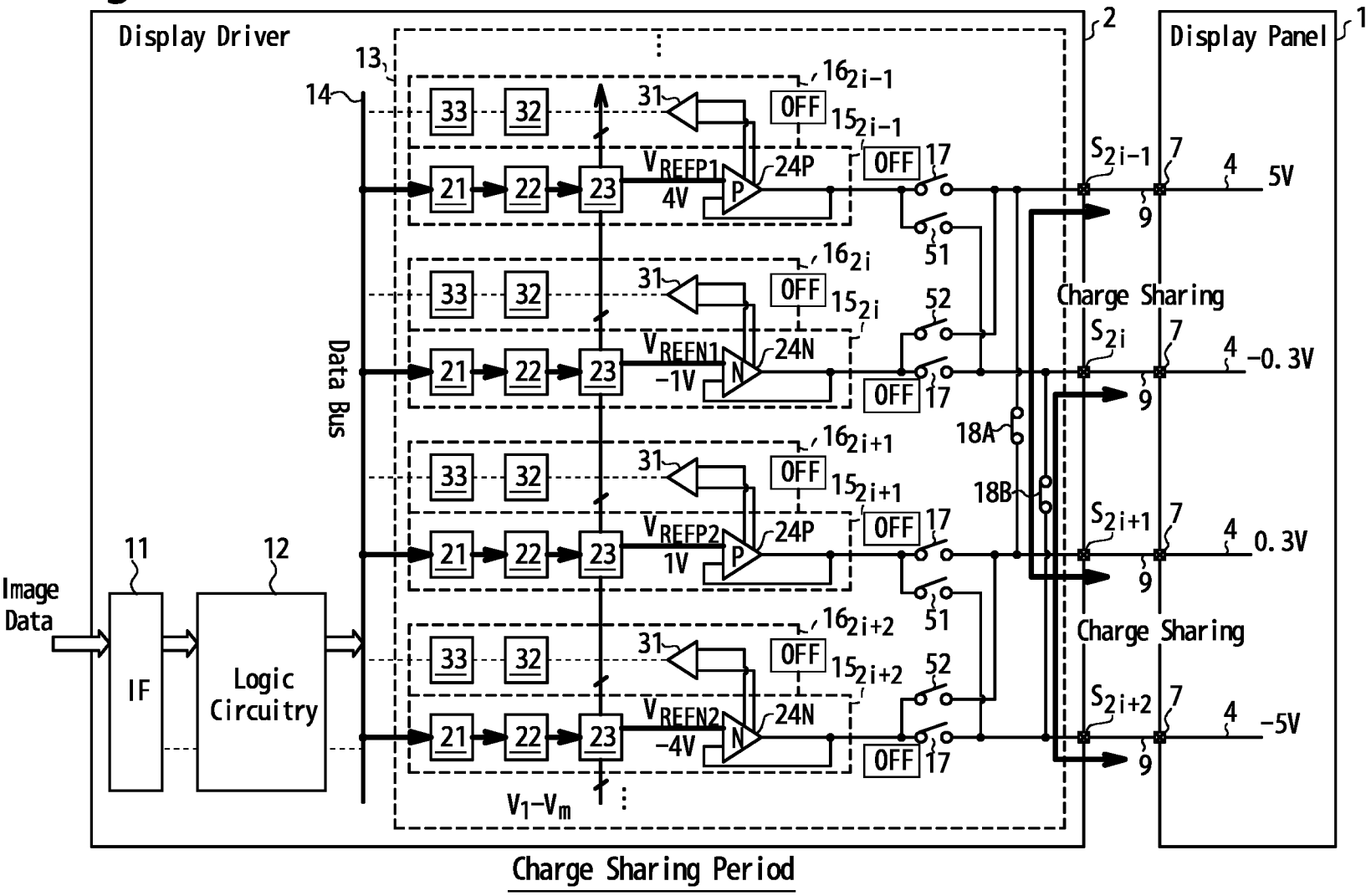
FIG. 23 illustrates one example operation of the display driver in a charge sharing period, according to one or more embodiments.

In one or more embodiments, as illustrated in FIG. 23, the short-circuit switches 18A and 18B are turned on and the output switches 17 and the cross switches 51 and 52 are turned off, during the charge sharing period following the panel charging period. In one or more embodiments, this achieves charge sharing between the COF interconnection 9 and source lines 4 connected to the external output terminals $S_{2i-1}$ and $S_{2i+1}$ and between the COF interconnection 9 and source lines 4 connected to the external output terminals $S_{2i}$ and $S_{2i+2}$.

In one or more embodiments, in the charge sharing period, a reference voltage $V_{REFP1}$ starts to be supplied from the decoder 23 to the positive-side source amplifier 24P in the output circuitry $\mathbf{15}_{2i-1}$, and a reference voltage $V_{REFP2}$ starts to be supplied from the decoder 23 to the positive-side source amplifier 24P in the output circuitry $\mathbf{15}_{2i+1}$. In one or more embodiments, in the charge sharing period, a reference voltage $V_{REFN1}$ starts to be supplied from the decoder 23 to the negative-side source amplifier 24N in the output circuitry $\mathbf{15}_{2i}$, and a reference voltage $V_{REFN2}$ starts to be supplied from the decoder 23 to the negative-side source amplifier 24N in the output circuitry $\mathbf{15}_{2i+2}$. In one or more embodiments, the reference voltages $V_{REFP1}$, $V_{REFP2}$, $V_{REFN1}$, and $V_{REFN2}$ are determined based on expected variations in the voltage on the COF interconnections 9 and source lines 4 for the case where the COF interconnections 9 and source lines 4 are free from faults. When source output voltages $V_{CHP1}$ and $V_{CHP2}$ of +5V and +0.3V are outputted to the external output terminals $S_{2i-1}$ and $S_{2i+1}$, respectively, the reference voltages $V_{REFP1}$ and $V_{REFP2}$ are set to +4V and +1V, respectively, in one or more embodiments. When source output voltages $V_{CHN1}$ and $V_{CHN2}$ of −0.3V and −5V are outputted to the external output terminals $S_{2i}$ and $S_{2i+2}$, respectively, the reference voltages $V_{REFN1}$ and $V_{REFN2}$ are set to −1V and −4V, respectively, in one or more embodiments.

Figure 24:
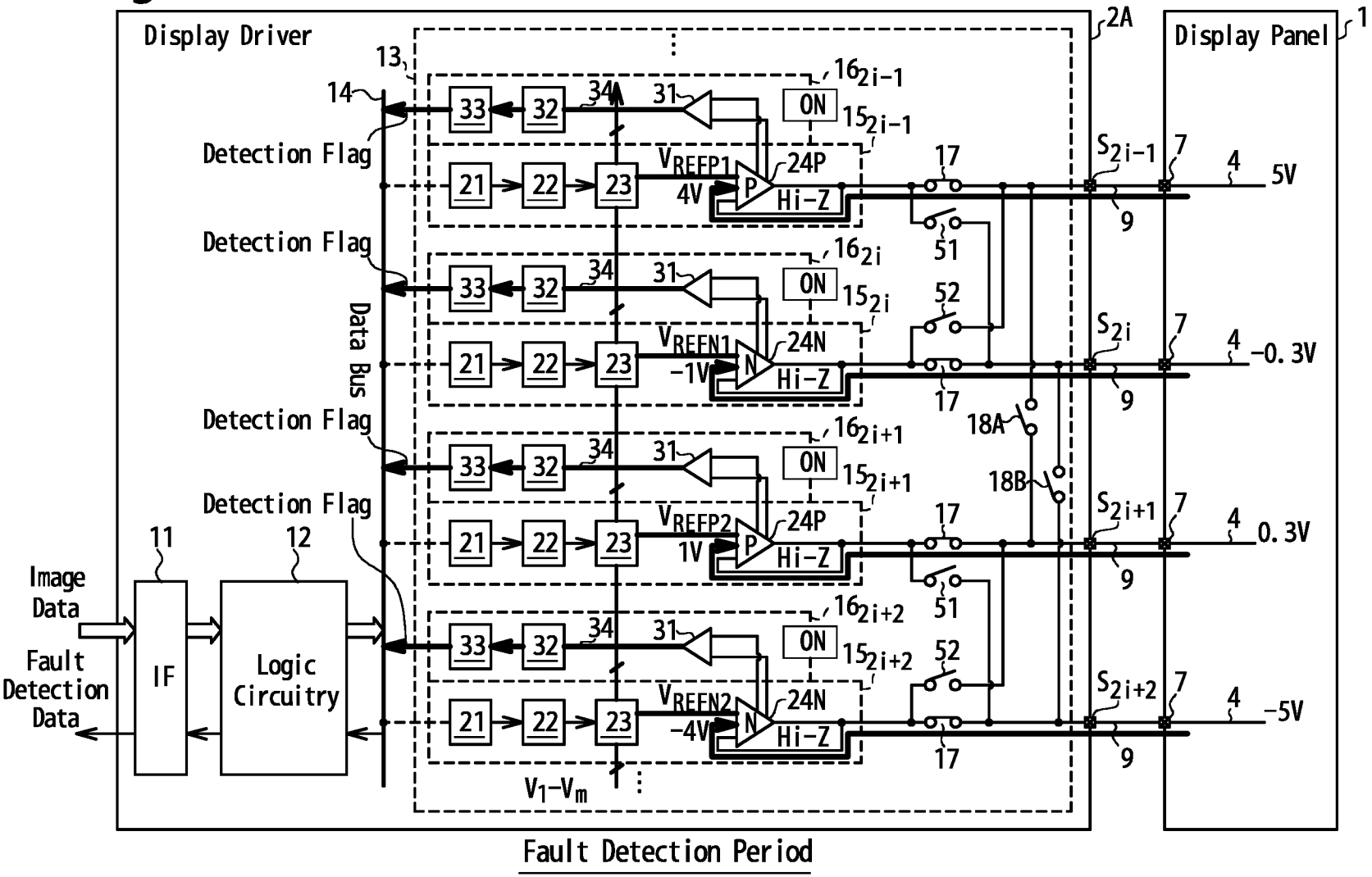
FIG. 24 illustrates one example operation of the display driver in a fault detection period, according to one or more embodiments.

In one or more embodiments, an open fault in the COF interconnections 9 and the source lines 4 is detected in the fault detection period following the charge sharing period. In one or more embodiments, as illustrated in FIG. 24, the output switches 17 are turned on during the fault detection period, and the outputs of the positive-side and negative-side source amplifiers 24P and 24N are set to high impedance. In one or more embodiments, the differential input stage (not illustrated) of the positive-side source amplifier 24P of the output circuitries $\mathbf{15}_{2i-1}$ is configured to generate output signals based on comparison between the reference voltages $V_{REFP1}$ and the voltage on the external output terminals $S_{2i-1}$ during the fault detection period. In one or more embodiments, the differential input stage (not illustrated) of the positive-side source amplifier 24P of the output circuitries $\mathbf{15}_{2i+1}$ is configured to generate output signals based on comparison between the reference voltages $V_{REFP2}$ and the voltage on the external output terminals $S_{2i+1}$. In one or more embodiments, the differential input stage (not illustrated) of the negative-side source amplifier 24N of the output circuitries $\mathbf{15}_{2i}$ is configured to generate output signals based on comparison between the reference voltages $V_{REFN1}$ and the voltage on the external output terminals $S_{2i}$ during the fault detection period. In one or more embodiments, the differential input stage (not illustrated) of the negative-side source amplifier 24N of the output circuitries $\mathbf{15}_{2i+2}$ is configured to generate output signals based on comparison between the reference voltages $V_{REFN2}$ and the voltage on the external output terminals $S_{2i+2}$.

In one or more embodiments, the comparison output circuitry 31 of each output circuitry 15 is configured to output the comparison output signal 34 based on the output signals of the differential input stage of the positive-side or negative-side source amplifier 24P or 24N during the fault detection period. In one or more embodiments, the comparison output signals 34 generated in the output circuitries $\mathbf{15}_{2i-1}$ and $\mathbf{15}_{2i+1}$ reflect the comparison results between the reference voltage $V_{REFP1}$ and the voltage on the external output terminal $S_{2i-1}$ and between the reference voltage $V_{REFP2}$ and the voltage on the external output terminal $S_{2i+1}$, respectively. In one or more embodiments, the comparison output signals 34 generated in the output circuitries $\mathbf{15}_{2i}$ and $\mathbf{15}_{2i+2}$ reflect the comparison results between the reference voltage $V_{REFN1}$ and the voltage on the external output terminal $S_{2i}$ and between the reference voltage $V_{REFN2}$ and the voltage on the external output terminal $S_{2i+2}$, respectively. In one or more embodiments, the values of the comparison output signals 34 are latched by the latches 33, and the values outputted from the latches 33 are used as the detection flags. In one or more embodiments, the detection flags outputted from the latches 33 of the test circuitries $\mathbf{16}_{2i-1}$, $\mathbf{16}_{2i}$, $\mathbf{16}_{2i+1}$, and $\mathbf{16}_{2i+2}$ are transferred to the logic circuitry 12, and used for detection of open faults in the COF interconnections 9 and source lines 4 connected to the external output terminals $S_{2i-1}$, $S_{2i}$, $S_{2i+1}$, and $S_{2i+2}$.

Figure 25:
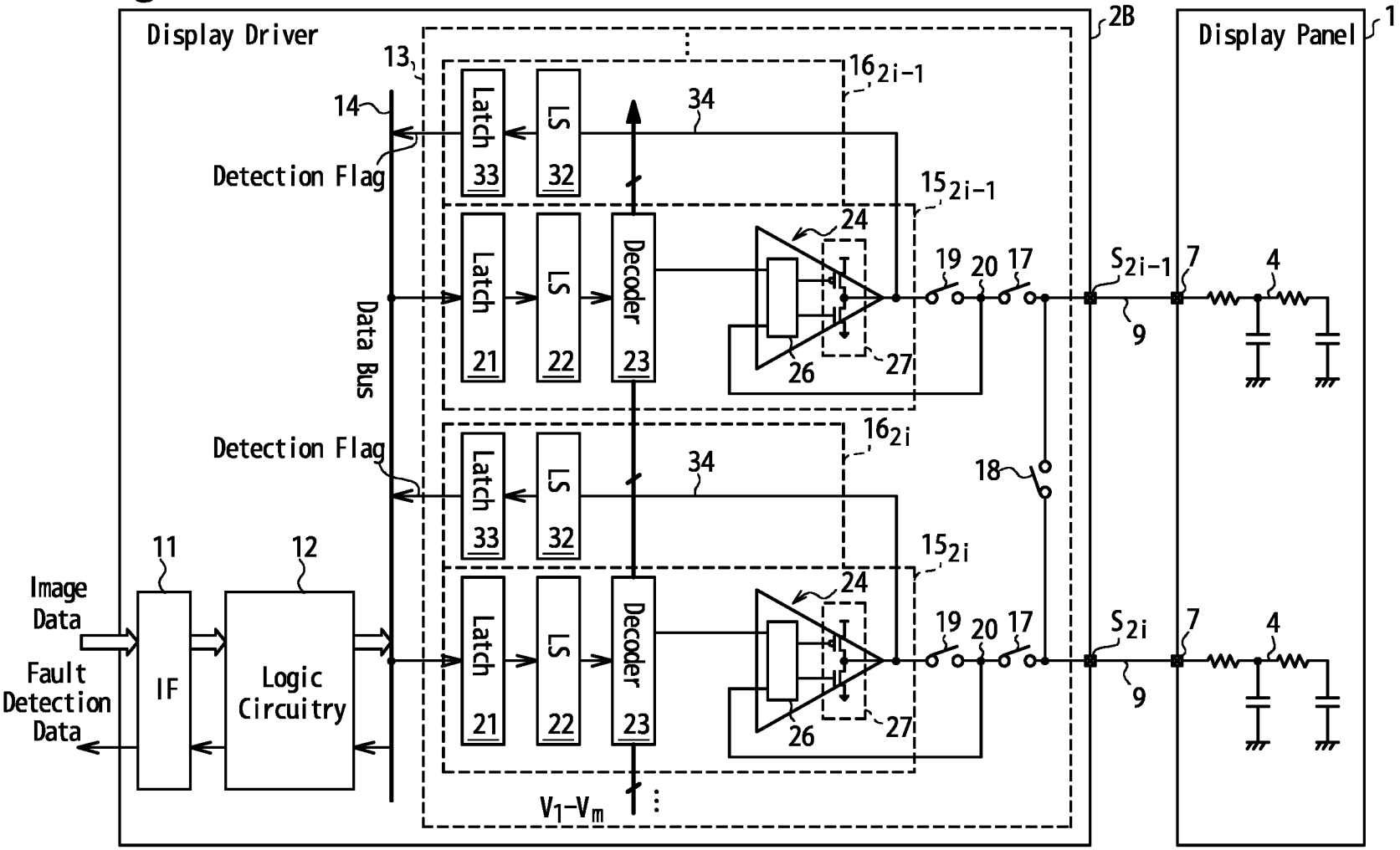
FIG. 25 illustrates one example configuration of a display drive, according to one or more embodiments.

In one or more embodiments, as illustrated in FIG. 25, comparison output circuitries 31 are removed from the display driver, which is denoted by numeral 2B in FIG. 25, and the outputs of the source amplifiers 24 are connected to the level shifters 32. In one or more embodiments, connection switches 19 are connected between the output nodes 20 and the outputs of the source amplifiers 24, and the output switches 17 are connected between the output nodes 20 and the external output terminals S. In one or more embodiments, a fault in the COF interconnections 9 and source lines 4 connected to the external output terminals $S_{2i-1}$ and $S_{2i}$ is detected through a test sequence similar to the above-described test sequence with respect to the display driver 2B configured as illustrated in FIG. 25.

Figure 26:
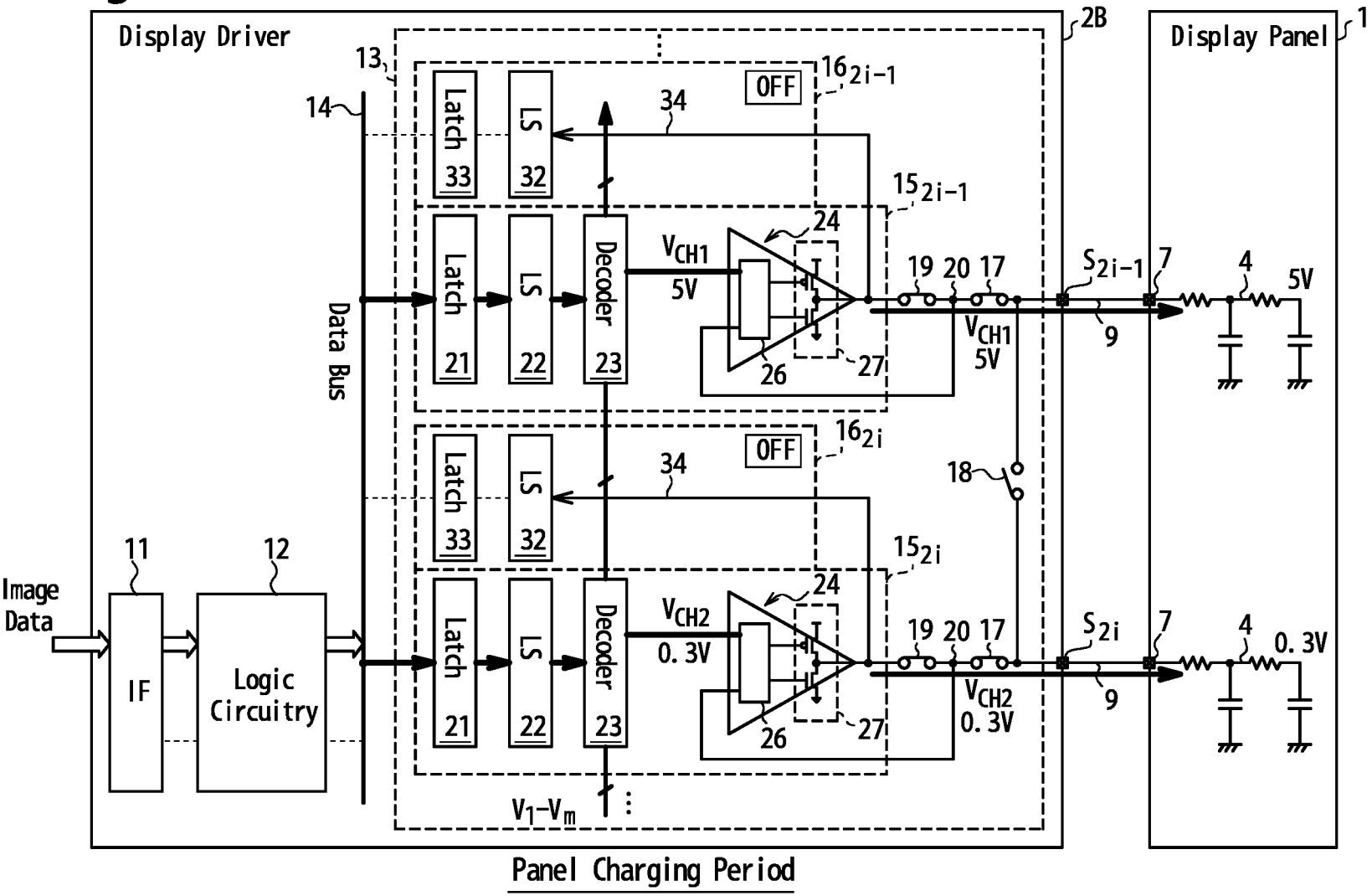
FIG. 26 illustrates one example operation of the display driver in a panel charging period, according to one or more embodiments.

In one or more embodiments, as illustrated in FIG. 26, adjacent source lines 4 are charged with different source output voltages during the panel charging period. In one or more embodiments, the output switches 17 and the connection switches 19 are turned on and the short-circuit switches 18 turned off, during the panel charging period. This allows outputting the desired source output voltages to the COF interconnections 9 and source lines 4 from the respective source amplifiers 24. Illustrated in FIG. 26 is one example operation in which the source output voltage $V_{CH1}$ of 5V is outputted to the odd-numbered external terminal $S_{2i-1}$ and the source output voltage $V_{CH2}$ of 0.3V is outputted to the even-numbered external terminal $S_{2i}$.

Figure 27:
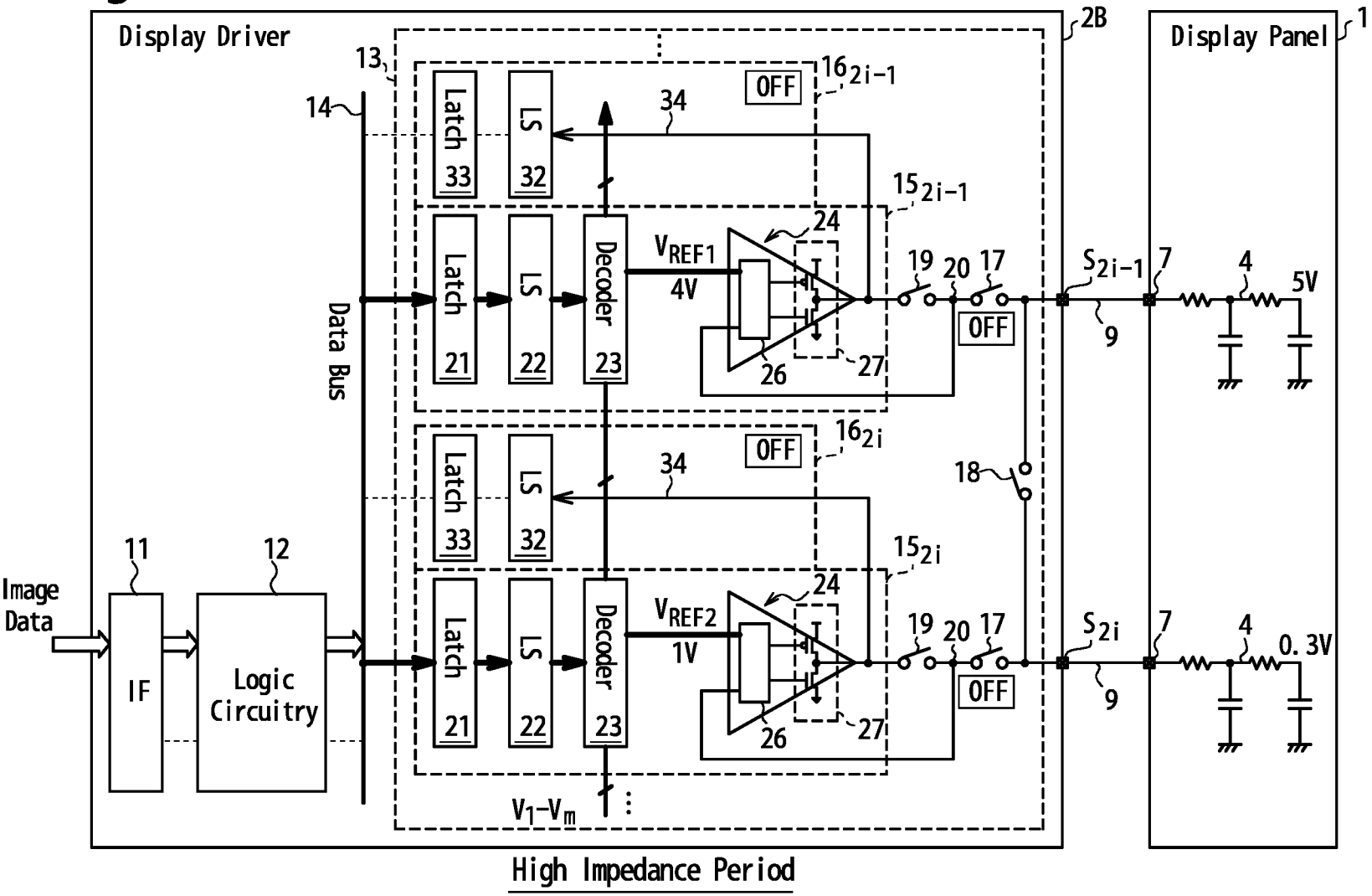
FIG. 27 illustrates one example operation of the display driver in a high impedance period, according to one or more embodiments.

In one or more embodiments, as illustrated in FIG. 27, the output switches 17, the short-circuit switches 18 and the connection switches 19 are then turned off during the high impedance period to set the COF interconnections 9 and the source lines 4 to high impedance. In one or more embodiments, the reference voltages $V_{REF1}$ and $V_{REF2}$ start to be supplied from the decoders 23 to the source amplifiers 24 in the output circuitries $\mathbf{15}_{2i-1}$ and $\mathbf{15}_{2i}$ in the high impedance period. In one or more embodiments, the reference voltages $V_{REF1}$ and $V_{REF2}$ are determined based on expected variations in the voltage on the COF interconnections 9 and source lines 4 for a case where the COF interconnections 9 and source lines 4 are free from faults.

Figure 28:
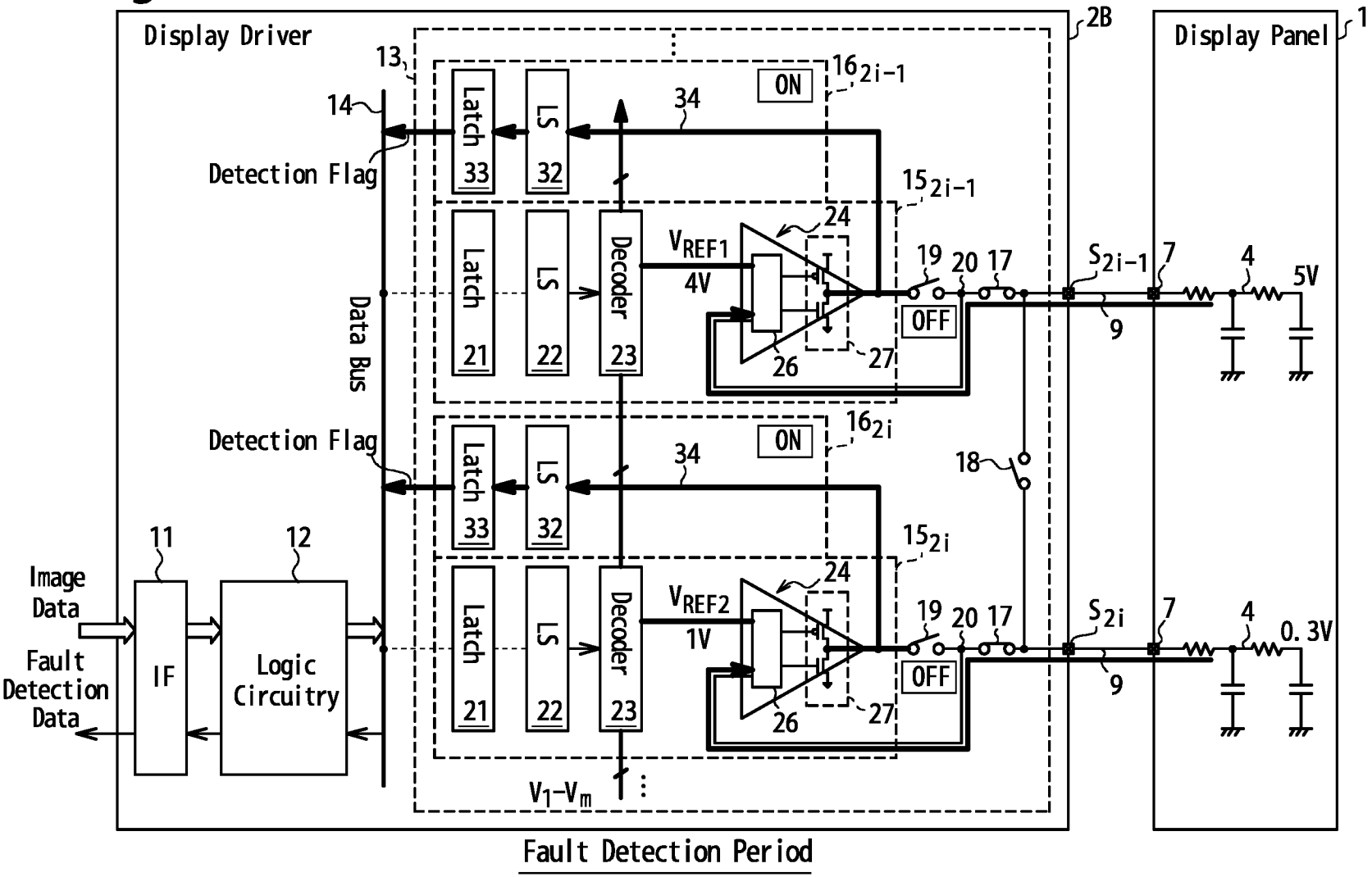
FIG. 28 illustrates one example operation of the display driver in a fault detection period, according to one or more embodiments.

In one or more embodiments, as illustrated in FIG. 28, fault detection is then performed for the COF interconnections 9 and the source lines 4 in the fault detection period. In one or more embodiments, the output switches 17 are turned on and the connection switches 19 turned off, during the fault detection period. In one or more embodiments, the source amplifiers 24 of the output circuitries $\mathbf{15}_{2i-1}$ and $\mathbf{15}_{2i}$ are configured to compare the reference voltages $V_{REF1}$ and $V_{REF2}$ with the voltages on the external output terminals $S_{2i-1}$ and $S_{2i}$, respectively, and generate output signals based on the comparisons. In one or more embodiments, the output signals outputted from the source amplifiers 24 are used as the comparison output signals 34 in the fault detection period. In one or more embodiments, the comparison output signals 34 reflect the comparison results between the reference voltages $V_{REF1}$ and $V_{REF2}$ and the voltages on the external output terminals $S_{2i-1}$ and $S_{2i}$. In one or more embodiments, the values of the comparison output signals 34 are latched by the latches 33, and the values outputted from the latches 33 are used as the detection flags. In one or more embodiments, the detection flags outputted from the latches 33 of the test circuitries $\mathbf{16}_{2i-1}$ and $\mathbf{16}_{2i}$ are transferred to the logic circuitry 12, and used for fault detection of the COF interconnections 9 and source lines 4 connected to the external output terminals $S_{2i-1}$ and $S_{2i}$.

Figure 29:
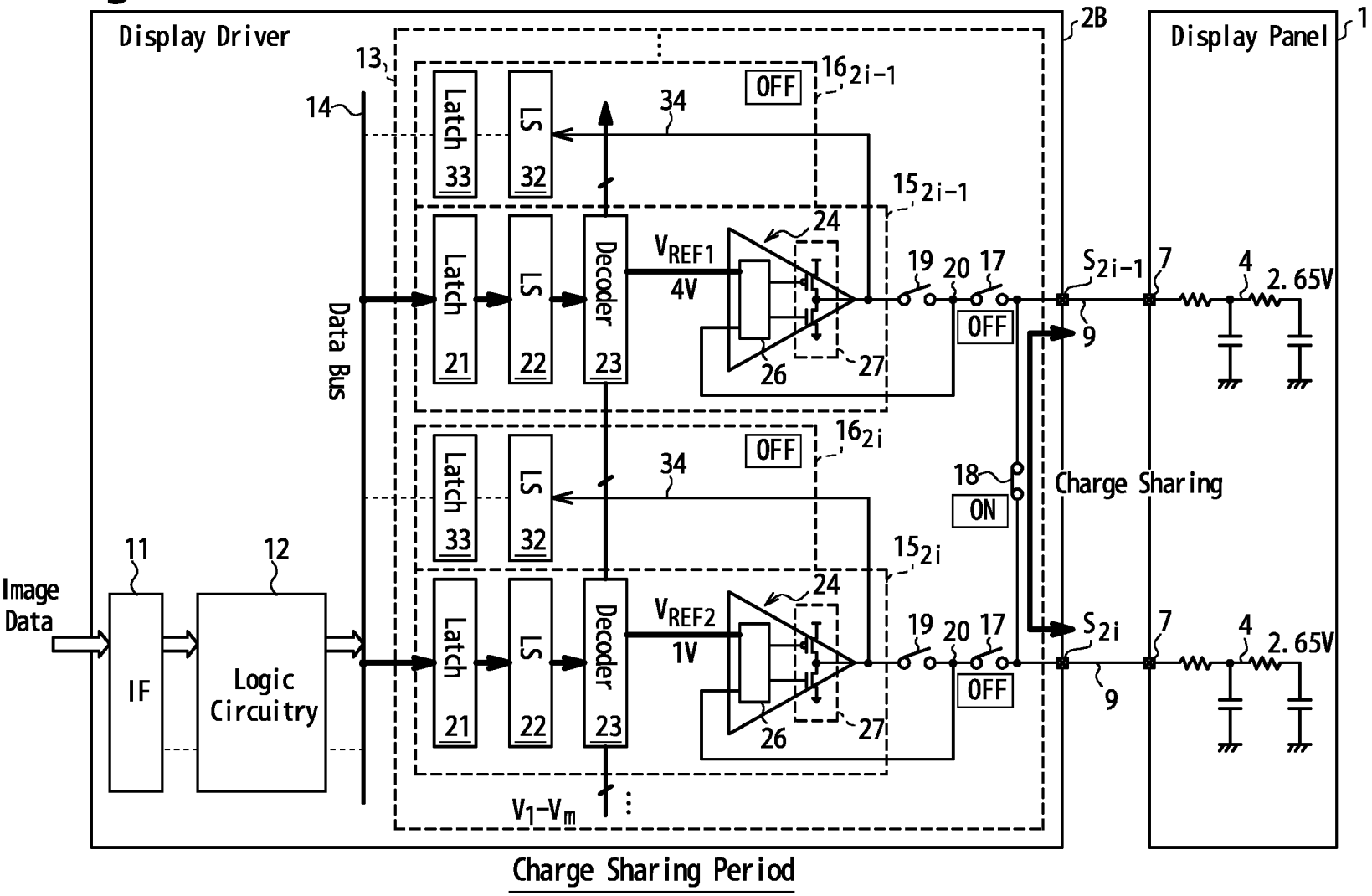
FIG. 29 illustrates one example operation of the display driver in a charge sharing period, according to one or more embodiments.

In one or more embodiments, a charge sharing period is disposed after the panel charging period in the test sequence, instead of the high impedance period. In one or more embodiments, as illustrated in FIG. 29, the output switches 17 and the connection switches 19 are tuned off and the short-circuit switches 18 are turned on, during the charge sharing period. In one or more embodiments, this achieves charge sharing between the COF interconnections 9 and source lines 4 connected to adjacent external output terminals $S_{2i-1}$ and $S_{2i}$.

In one or more embodiments, an open fault in the COF interconnections 9 and the source lines 4 is detected in the fault detection period following the charge sharing period, in a similar manner to the operation illustrated in FIG. 27. In one or more embodiments, the source amplifiers 24 of the output circuitries $\mathbf{15}_{2i-1}$ and $\mathbf{15}_{2i}$ are configured to compare the reference voltages $V_{REF1}$ and $V_{REF2}$ with the voltages on the external output terminals $S_{2i-1}$ and $S_{2i}$ in the fault detection period and output the comparison output signals 34 based on the comparisons. In one or more embodiments, the values of the comparison output signals 34 are latched by the latches 33, and the values outputted from the latches 33 are used as the detection flags. In one or more embodiments, the detection flags outputted from the latches 33 of the test circuitries $\mathbf{16}_{2i-1}$ and $\mathbf{16}_{2i}$ are transferred to the logic circuitry 12 and used for detection of an open fault in the COF interconnections 9 and source lines 4 connected to the external output terminals $S_{2i-1}$ and $S_{2i}$.

Figure 30:
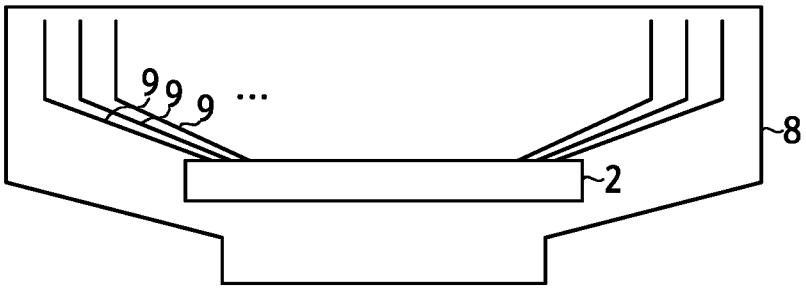
FIG. 30 illustrates one example configuration of a chip-on-flexible printed circuit (COF), according to one or more embodiments.

In one or more embodiments, as illustrated in FIG. 30, any of the above-described test sequences are performed before the COF 8 is connected to the display panel 1. In such embodiments, the test objects for which a fault is to be detected are the COF interconnections 9, and a fault in the COF interconnections 9 such as a short fault and an open fault is detected.

Figure 31:
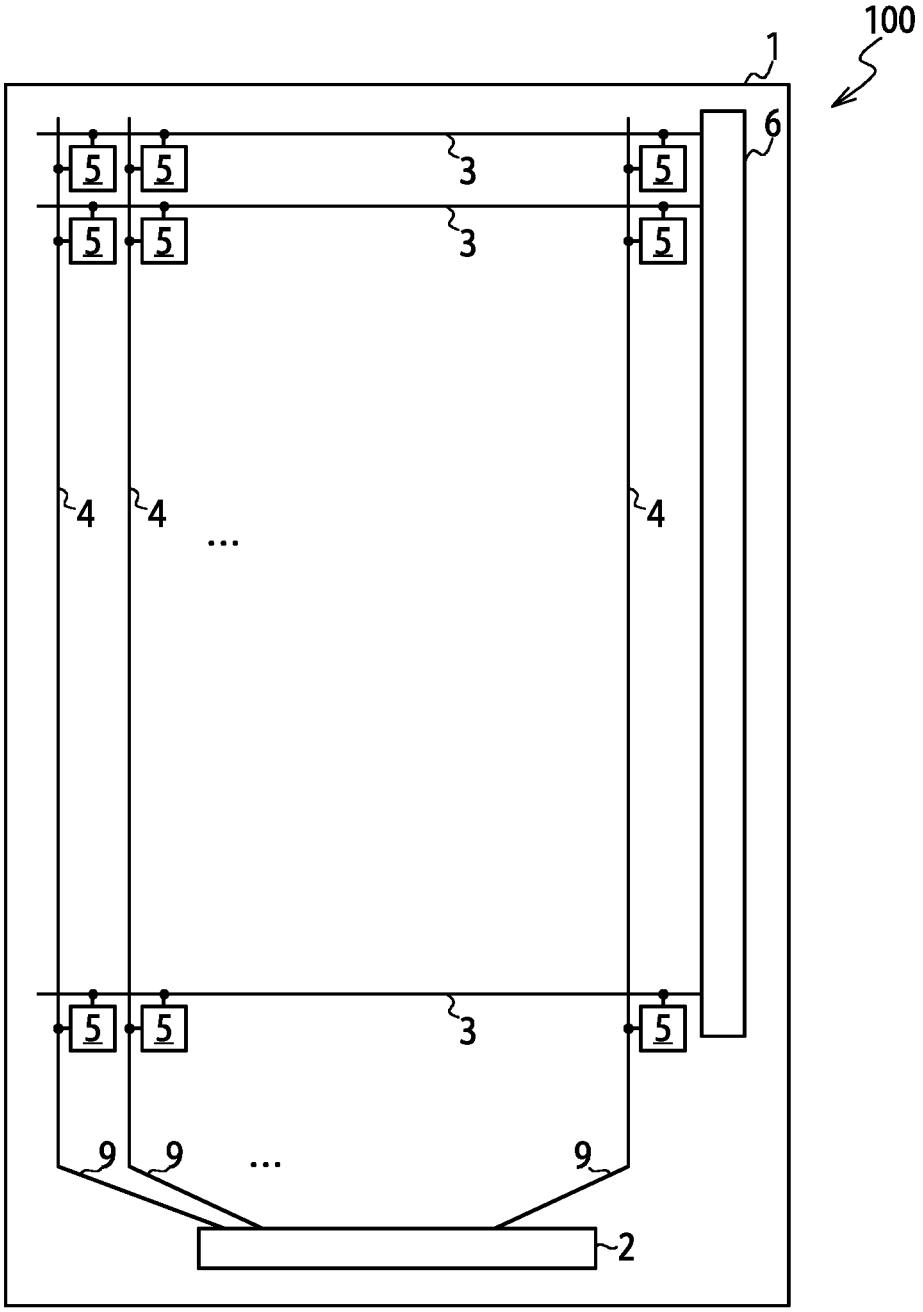
FIG. 31 illustrates one example configuration of a display module, according to one or more embodiments.

In one or more embodiments, as illustrated in FIG. 31, the display driver 2 is mounted on the display panel 1 through a chip-on-glass (COG) bonding technique. In this case, the external output terminals S of the display driver 2 are connected to the source lines 4 of the display panel 1, in one or more embodiments. In one or more embodiments, any of the above-described test sequences are performed after the display driver 2 is mounted on the display panel 1. In such embodiments, the test objects for which faults are to be detected are the source lines 4, and a fault of the source lines 4 such as a short fault and an open fault are detected.

Figure 32:
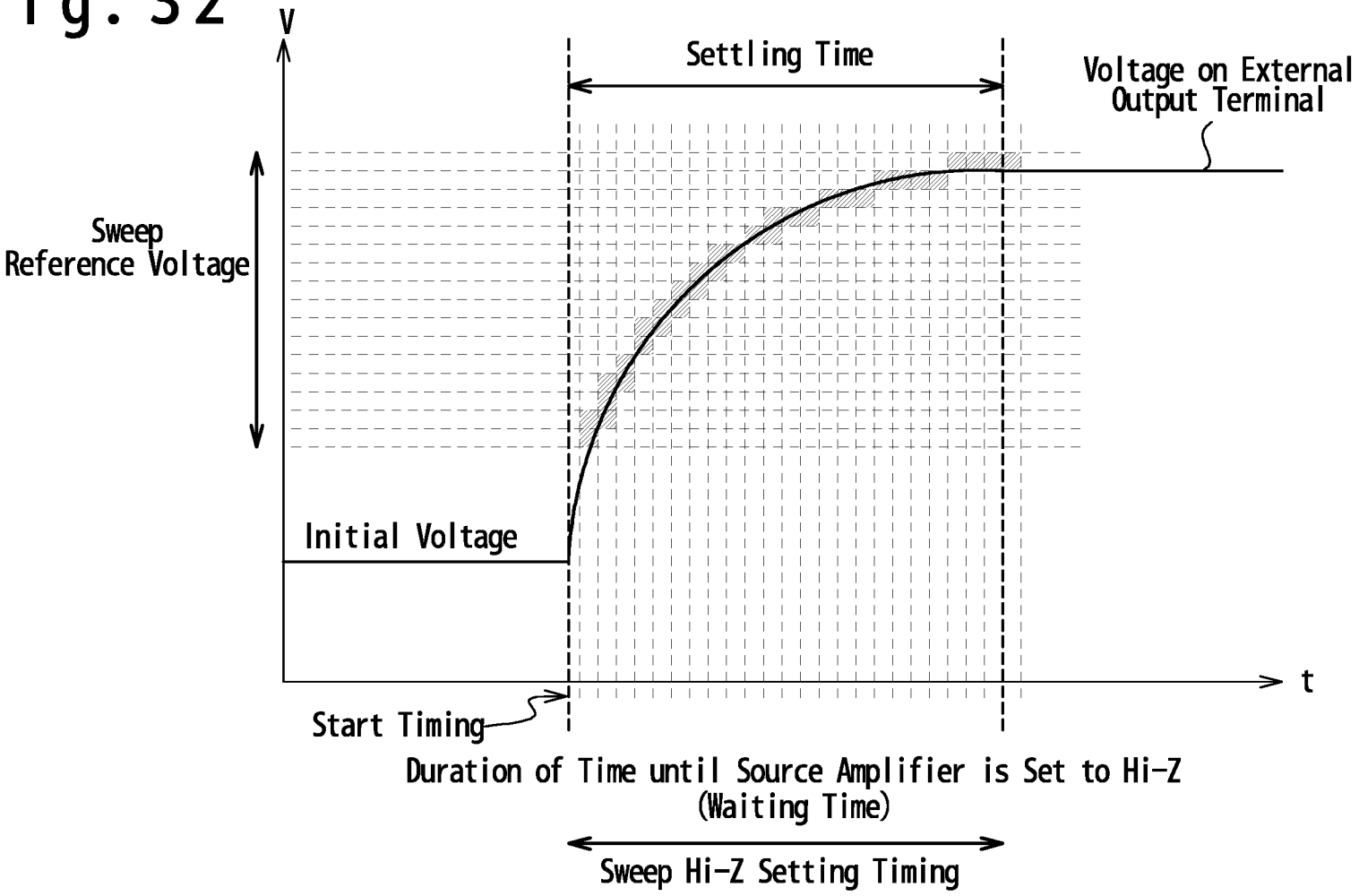
FIG. 32 illustrates measurement of a settling time of a source amplifier, according to one or more embodiments.

In one or more embodiments, the test circuities 16 are used to measure the characteristics of the source amplifiers 24, including the settling times. In one or more embodiments, as illustrated in FIG. 32, the settling time of a source amplifier 24 is measured as a duration of time until the voltage on the corresponding external output terminal S gets stable after the source amplifier 24 starts to output a source output voltage. In one or more embodiments, the measurement of the settling time of a source amplifier 24 involves repeatedly comparing the voltage on the corresponding external output terminal S with a reference voltage at the time when a desired waiting time has expired after the source output voltage starts to be outputted, while sweeping the waiting time and the reference voltages. In one or more embodiments, the voltage on the external output terminal S is compared with reference voltages of different voltage levels for each waiting time. In one or more embodiments, the settling time of the source amplifier 24 is measured based on the comparison results repeatedly obtained in this way.

Figure 33:
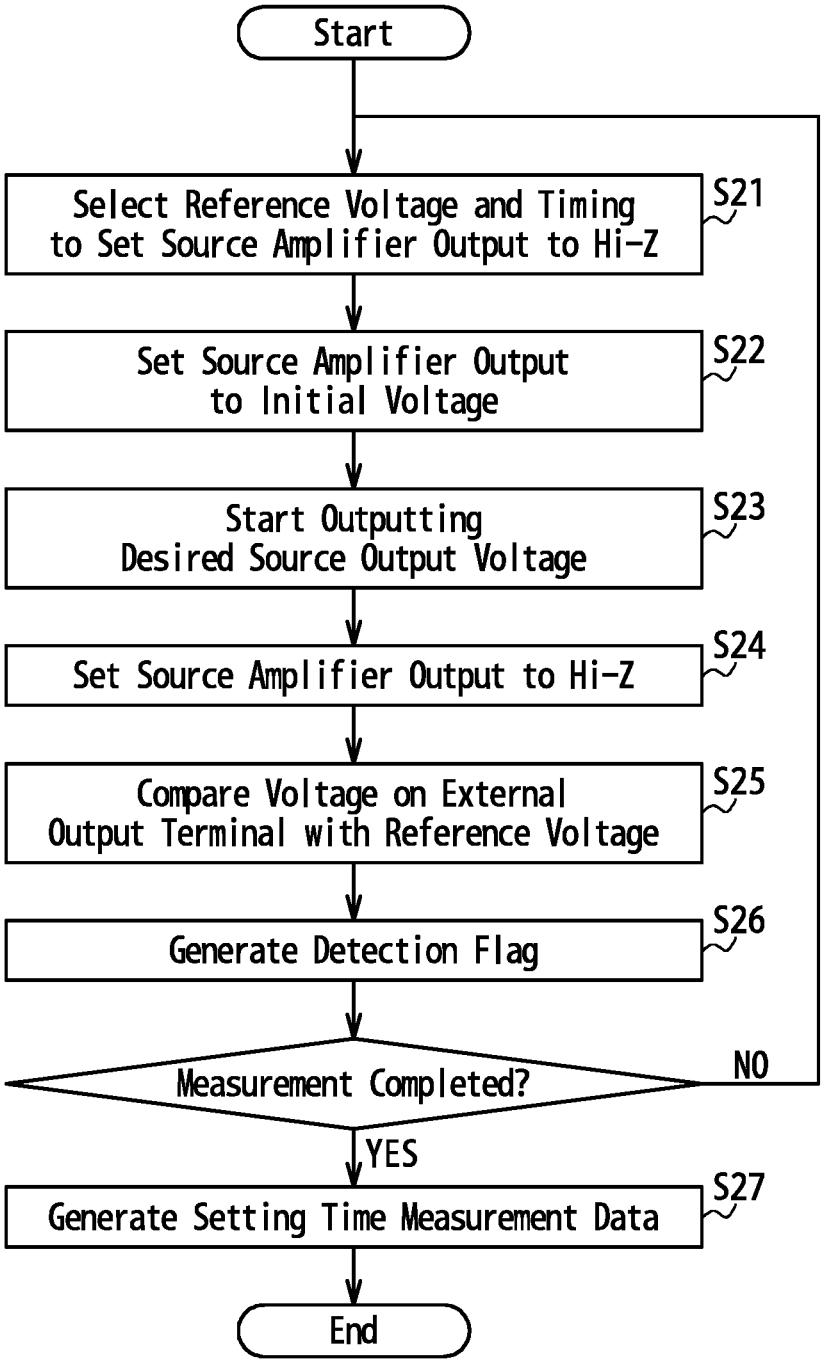
FIG. 33 illustrates an example measurement sequence of a settling time of a source amplifier, according to one or more embodiments.

In one or more embodiments, the settling times of the source amplifiers 24 of the output circuitries $\mathbf{15}_{2i-1}$ and $\mathbf{15}_{2i}$ of the display drivers 2 or 2A illustrated in FIG. 2 or 18 are measured through a measurement sequence illustrated in FIG. 33. In one or more embodiments, the reference voltages $V_{REF1}$ and $V_{REF2}$ and the timing at which the outputs of the source amplifiers 24 are set to high impedance after the source amplifier 24 starts to output a source output voltage are selected in step S21. In one or more embodiments, the timing at which the outputs of the source amplifiers 24 are set to high impedance corresponds to the above-described waiting time, because the voltages on the external output terminals $S_{2i-1}$ and $S_{2i}$ are compared with the reference $V_{REF1}$ and $V_{REF2}$ when the outputs of the source amplifiers 24 are set to the high impedance in a later step. In one or more embodiments, the outputs of the source amplifiers 24 are set to an initial voltage in step S22. In one or more embodiments, the source amplifiers 24 start to output desired source output voltages in step S23. In one or more embodiments, in step S24, the outputs of the source amplifiers 24 are set to high impedance at the timing selected in step S21. In one or more embodiments, in step S25, the voltages on the external output terminals $S_{2i-1}$ and $S_{2i}$ are compared with the reference voltages $V_{REF1}$ and $V_{REF2}$, immediately after the outputs of the source amplifiers 24 are set to high impedance. In one or more embodiments, in step S26, the comparison output signals 34 are generated based on the comparisons of the voltages on the external output terminals $S_{2i-1}$ and $S_{2i}$ with the reference voltages $V_{REF1}$ and $V_{REF2}$, and the detection flags are generated based on the comparison output signals 34.

In one or more embodiments, when detection flags have not yet been obtained for all the desired combinations of the timing to set the outputs of the source amplifiers 24 to high impedance and the voltage levels of the reference voltages $V_{REF1}$ and $V_{REF2}$, the measurement procedure goes back to step S21 to perform steps S21 to S26 again. In one or more embodiments, after the detection flags are obtained for all the desired combinations, the logic circuitry 12 generates a settling time measurement data reflecting the settling times of the source amplifiers 24 based on the detection flags in step S27.

In one or more embodiments, the settling times of the source amplifiers 24 are determined based on the detection flags, and the settling time measurement data describes the determined settling times. In one or more embodiments, when the timing to set the outputs of the source amplifiers 24 to high impedance is fixed, ranges of the respective source output voltages at a time point when the waiting time for the timing has expired after the source amplifiers 24 start to output the source output voltages can be obtained based on the detection flags obtained based on the comparisons of the voltages on the external output terminals $S_{2i-1}$ and $S_{2i}$ with the reference voltages $V_{REF1}$ and $V_{REF2}$. In one or more embodiments, the settling times can be determined with a certain level of certainty based on the detection flags obtained while variously changing the timing to set the outputs of the source amplifiers 24 to high impedance. In one or more embodiments, the settling time measurement data incorporates the obtained detection flags without modification. In one or more embodiments, the settling time measurement data is transmitted to an external device, such as a tester, via the interface 11 and used for evaluation of the source amplifiers 24.

In one or more embodiments, the settling times of the source amplifiers 24 of the output circuitries $\mathbf{15}_{2i-1}$ and $\mathbf{15}_{2i}$ of the display driver 2B illustrated in FIG. 25 are measured through a measurement sequence similar to the measurement sequence illustrated in FIG. 33. In such embodiments, the connection switches 19 are controlled during the measurement sequence. In one or more embodiments, the connection switches 19 are turned on in step S23, and the connection switches 19 are turned off in step S24, in place of setting the outputs of the source amplifiers 24 to high impedance.

Although various embodiments of the present disclosure have been specifically described, a skilled person would appreciate that the technologies described in this disclosure may be implemented with various modifications.

What is claimed is:

1. A display driver, comprising:

a decoder configured to output a grayscale voltage corresponding to an image data;

a first source amplifier configured to output a first source output voltage corresponding to the grayscale voltage to a first external output terminal, wherein the first source amplifier comprises:

a differential input stage comprising a first input electrically connectable to the first external output terminal and a second input configured to receive the grayscale voltage and a reference voltage, and an output stage connected to the differential input stage and configured to output the first source output voltage;

comparison output circuitry configured to output a comparison output signal based on an output signal of the differential input stage; and logic circuitry configured to generate fault detection data for fault detection of a test object connected to the first external output terminal based on the comparison output signal generated based on a comparison performed by the first source amplifier between the reference voltage and a voltage on the first external output terminal.

2. The display driver according to claim 1, wherein the decoder is further configured to supply the reference voltage to the first source amplifier.

3. The display driver according to claim 1, wherein the output stage is configured to set the output of the first source amplifier to high impedance.

4. The display driver according to claim 3, wherein the decoder is further configured to supply the reference voltage to the first source amplifier, and wherein supplying the reference voltage to the first source amplifier, setting the output of the first source amplifier to high impedance, and outputting the comparison output signal are performed during a fault detection period.

5. The display driver according to claim 4, further comprising:

an output node commonly connected to an output of the first source amplifier and the first input of the differential input stage; and an output switch connected between the output node and the first external output terminal, wherein the first source amplifier is configured to output a second source output voltage during a panel charging period, wherein the output switch is configured to be turned on during the panel charging period, turned off during a high impedance period following the panel charging period, and turned on during the fault detection period, wherein the fault detection period follows the high impedance period.

6. The display driver according to claim 5, further comprising a second source amplifier comprising an output electrically connectable to a second external output terminal, wherein the second source amplifier is configured to output a third source output voltage different from the second source output voltage during the panel charging period.

7. The display driver according to claim 6, wherein the reference voltage has a voltage level between the second source output voltage and the third source output voltage.

8. The display driver according to claim 1, further comprising:

an output node commonly connected to the first input and an output of the first source amplifier;

an output switch connected between the first external output terminal and the output node;

a second source amplifier comprising an output electrically connectable to a second external output terminal; and a short-circuit switch connected between the first external output terminal and the second external output terminal.

9. The display driver according to claim 8, wherein the first source amplifier is configured to output a second source output voltage during a panel charging period, wherein the second source amplifier is configured to output a third source output voltage different from the second source output voltage during the panel charging period, wherein the output switch is configured to be turned on during the panel charging period, turned off during a charge sharing period following the panel charging period, and turned on during a fault detection period following the charge sharing period, wherein the short-circuit switch is configured to be turned off during the panel charging period, turned on during the charge sharing period, and turned off during the fault detection period, wherein the first source amplifier is configured to set the output thereof to high impedance during the fault detection period, and wherein the comparison output circuitry is configured to output the comparison output signal during the fault detection period.

10. The display driver according to claim 8, further comprising:

a third external output terminal disposed between the first external output terminal and the second external output terminal; and a third source amplifier comprising an output electrically connectable to the third external output terminal, wherein the first source amplifier and the second source amplifier are configured to generate source output voltages of a first polarity, lacking an ability to output a source output voltage of a second polarity different from the first polarity, and wherein the third source amplifier is configured to generate source output voltages of the second polarity, lacking an ability to output a source output voltage of the first polarity.

11. The display driver according to claim 1, further comprising:

an output node connected to the first input of the first source amplifier;

a connection switch connected between an output of the first source amplifier and the output node; and an output switch connected between the output node and the first external output terminal, wherein the comparison output signal is generated on the output of the first source amplifier.

12. A display driver comprising:

a decoder configured to output a grayscale voltage corresponding to an image data;

a first source amplifier configured to output a first source output voltage corresponding to the grayscale voltage to a first external output terminal;

logic circuitry configured to generate fault detection data for fault detection of a test object connected to the first external output terminal based on a comparison output signal generated based on a comparison performed by the first source amplifier between a reference voltage and a voltage on the first external output terminal;

an output node connected to a first input of the first source amplifier;

a connection switch connected between an output of the first source amplifier and the output node; and an output switch connected between the output node and the first external output terminal, wherein the comparison output signal is generated on the output of the first source amplifier, wherein the first source amplifier is configured to output a second source output voltage during a panel charging period, wherein the output switch is configured to be turned on during the panel charging period, turned off during a high impedance period following the panel charging period, and turned on during a fault detection period following the high impedance period, wherein the connection switch is configured to be turned on during the panel charging period and turned off during the high impedance period and the fault detection period, and wherein the decoder is configured to supply the reference voltage to the first source amplifier at least during the fault detection period.

13. A display driver comprising:

a decoder configured to output a grayscale voltage corresponding to an image data;

a first source amplifier configured to output a first source output voltage corresponding to the grayscale voltage to a first external output terminal;

logic circuitry configured to generate fault detection data for fault detection of a test object connected to the first external output terminal based on a comparison output signal generated based on a comparison performed by the first source amplifier between a reference voltage and a voltage on the first external output terminal;

an output node connected to a first input of the first source amplifier;

a connection switch connected between an output of the first source amplifier and the output node;

an output switch connected between the output node and the first external output terminal, wherein the comparison output signal is generated on the output of the first source amplifier, a second source amplifier comprising an output electrically connectable to a second external output terminal; and a short-circuit switch connected between the first external output terminal and the second external output terminal, wherein the first source amplifier is configured to output a second source output voltage during a panel charging period, wherein the second source amplifier is configured to output a third source output voltage different from the second source output voltage during the panel charging period, wherein the output switch is configured to be turned on during the panel charging period, turned off during a charge sharing period following the panel charging period, and turned on during a fault detection period following the charge sharing period, wherein the connection switch is configured to be turned on during the panel charging period and turned off during the charge sharing period and the fault detection period, wherein the short-circuit switch is turned off during the panel charging period, turned on during the charge sharing period, and turned off during the fault detection period, and wherein the decoder is configured to supply the reference voltage to the first source amplifier at least during the fault detection period.

14. A display module, comprising:

a display panel comprising a source line; and a display driver comprising:

an external output terminal electrically connected to the source line;

a decoder configured to output a grayscale voltage corresponding to an image data;

a source amplifier configured to output a source output voltage corresponding to the grayscale voltage to the external output terminal, wherein the source amplifier comprises:

a differential input stage comprising a first input electrically connectable to the external output terminal and a second input configured to receive the grayscale voltage and a reference voltage; and an output stage connected to the differential input stage and configured to output the source output voltage, comparison output circuitry configured to output a comparison output signal based on an output signal of the differential input stage; and logic circuitry configured to generate fault detection data for fault detection of the source line based on the comparison output signal generated based on a comparison performed by the source amplifier between the reference voltage and a voltage on the external output terminal.

15. The display module according to claim 14, wherein the display driver further comprises:

an output node connected to the first input of the source amplifier;

a connection switch connected between an output of the source amplifier and the output node; and an output switch connected between the output node and the external output terminal, wherein the comparison output signal is generated on the output of the source amplifier.

16. A testing method, comprising:

supplying a reference voltage to a source amplifier configured to receive a grayscale voltage corresponding to an image data and output a first source output voltage corresponding to the grayscale voltage to a first external output terminal, wherein the source amplifier comprises:

a differential input stage comprising a first input electrically connectable to the first external output terminal and a second input configured to receive the grayscale voltage and the reference voltage; and an output stage connected to the differential input stage and configured to output the first source output voltage;

outputting a comparison output signal based on comparison performed by the source amplifier between the reference voltage and a voltage on the first external output terminal, wherein outputting the comparison output signal comprises outputting the comparison output signal based on an output signal of the differential input stage; and detecting a fault in a test object connected to the first external output terminal based on the comparison output signal.

17. The testing method according to claim 16, further comprising:

outputting a second source output voltage to the first external output terminal from the source amplifier during a first period; and disconnecting the first external output terminal from the source amplifier during a second period following the first period, wherein outputting the comparison output signal comprises:

connecting the first external output terminal to an input of the source amplifier during a third period following the second period; and outputting the comparison output signal based on comparison performed by the differential input stage between the reference voltage and a voltage on the first external output terminal during the third period.

18. The testing method according to claim 17, further comprising:

outputting a third source output voltage different from the second source output voltage to a second external output terminal during the first period; and short-circuiting the first external output terminal and the second external output terminal during the second period.

* * * * *